US009886959B2

(12) United States Patent
Holmes

(10) Patent No.: US 9,886,959 B2
(45) **Date of Patent: *Feb. 6, 2018**

(54) METHOD AND SYSTEM FOR LOW BIT RATE VOICE ENCODING AND DECODING APPLICABLE FOR ANY REDUCED BANDWIDTH REQUIREMENTS INCLUDING WIRELESS

(71) Applicant: Open Invention Network, LLC, Durham, NC (US)

(72) Inventor: Clyde Holmes, San Antonio, TX (US)

(73) Assignee: Open Invention Network LLC, Durham, NC (US)

( * ) Notice: Subject to any disclaimer, the term of this patent is extended or adjusted under 35 U.S.C. 154(b) by 530 days.

This patent is subject to a terminal disclaimer.

(21) Appl. No.: 14/050,042

(22) Filed: Oct. 9, 2013

(65) Prior Publication Data

US 2014/0108007 A1 Apr. 17, 2014

Related U.S. Application Data

(63) Continuation-in-part of application No. 12/070,090, filed on Feb. 15, 2008, now Pat. No. 7,970,607, which is a continuation-in-part of application No. 11/055,912, filed on Feb. 11, 2005, now Pat. No. 7,359,853.

(60) Provisional application No. 61/711,320, filed on Oct. 9, 2012, provisional application No. 61/714,840, filed on Oct. 17, 2012.

(51) Int. Cl.

| | |
|---|---|
| ***G10L 19/00*** | (2013.01) |
| ***G10L 19/002*** | (2013.01) |
| ***G10L 19/06*** | (2013.01) |
| ***G10L 19/08*** | (2013.01) |
| *G10L 25/09* | (2013.01) |

(52) U.S. Cl.

CPC ..... *G10L 19/002* (2013.01); *G10L 19/06* (2013.01); *G10L 19/08* (2013.01); *G10L 25/09* (2013.01)

(58) Field of Classification Search

CPC ..... G10L 19/06; G10L 19/022; G10L 25/09; G10L 25/60

USPC ..... 704/213

See application file for complete search history.

(56) References Cited

U.S. PATENT DOCUMENTS

| | | | | |
|---|---|---|---|---|
| 4,039,754 | A * | 8/1977 | Lokerson | G10L 15/00 704/209 |
| 5,035,242 | A * | 7/1991 | Franklin | A61F 11/04 607/108 |
| 5,157,727 | A * | 10/1992 | Schloss | G10L 15/02 704/213 |
| 7,454,330 | B1 * | 11/2008 | Nishiguchi et al. | 704/224 |
| 8,639,503 | B1 * | 1/2014 | Darroudi | G10L 19/04 704/200 |
| 2009/0287480 | A1 * | 11/2009 | Mapes-Riordan et al. | 704/225 |

(Continued)

*Primary Examiner* — Daniel Abebe

(74) *Attorney, Agent, or Firm* — Haynes and Boone, LLP

(57) ABSTRACT

A voice encoder/decoder (vocoder) may provide receiving a voice sample and generating zero crossings of the voice sample in response to voice excitation in a first formant and creating a corresponding output signal. Additional operations may include dividing the output signal by two, and sampling the output signal at a predefined frequency such that a resulting combination uses half of a bit rate for an excitation and a remainder for short term spectrum analysis.

18 Claims, 23 Drawing Sheets

(56) References Cited

U.S. PATENT DOCUMENTS

2013/0173261 A1* 7/2013 Huang et al. ..... 704/222

* cited by examiner

EXCITATION EXTRACTION

VOCODER RECEIVER

VOICE EXCITED CHANNEL VOCODER TRANSMITTER

VOICE EXCITED CHANNEL VOCODER TRANSMITTER

2400 BITS PER SECOND EXCITATION

1600 BITS PER SECOND EXCITATION

CHANNEL VOCODER RECEIVER

CHANNEL VOCODER RECEIVER

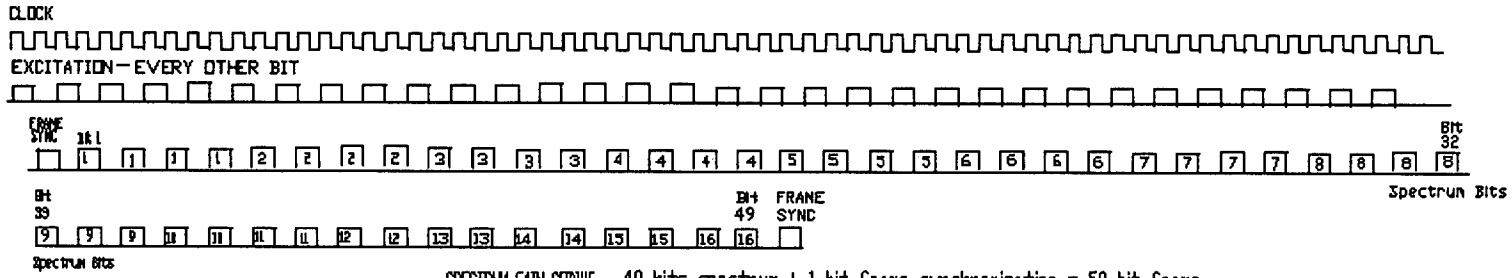

SPECTRUM GAIN CODING 49 bits spectrum + 1 bit frame synchronization = 50 bit frame Frame Rate is 48 frames per second Frame Rate x Frames/second = 50 x 48 = 2400 Bits Per Second EXCITATION 1/2 bit rate continuous = 2400 bits per second The short term power spectrum frequency bands are encoded using 4 bits for the magnitude. Channel 1 through 8 use the full 4 bits. Channel 9 is compared with channel 8 and the difference, 3 least significant bits are sent. channels 10, 11, 12, 13, 14, 15, and 16 use the difference from the previous channel, and two least significant bits are encoded.

4800 BITS PER SECOND TIMING

FIGURE 7

ASYNCHRONOUS FRAME Total Frame = 84 bits+ One Frame Sync bit

FRAME RATE = 21.25 MILLISECONDS (47.059 HZ) X 85 BITS PER FRAME = 4000 BPS

USING 8 BIT WORDS AND ADDING START AND STOP BITS = 4800 BPS

2400 BITS PER SECOND VOCODER TRANSMITTER

2400 BITS PER SECOND VOCODER TRANSMITTER

2400 BITS PER SECOND VOCODER RECEIVER

Each band of power spectrum frequencies is encoded using 4 bits each for their magnitude. The previous spectrum bands magnitude is compared with the next magnitude and the difference is sent. Channel one uses the full four bits, channel 2 through 13 use the two most significant bits. Channels 14 through 15 use only one bit each.

2400 BITS PER SECOND TIMING

SPECTRAL FLATTENER AND SPECTRAL GAIN RESTORATION

Block Diagram of a Linear Predictive Vocoder using a voice/unvoiced decision and a Pitch Detector BLOCK DIAGRAM OF A LINEAR PREDICTIVE VOCODER USING THIS INVENTIONS VOICE EXCITATION

METHOD AND SYSTEM FOR LOW BIT RATE VOICE ENCODING AND DECODING APPLICABLE FOR ANY REDUCED BANDWIDTH REQUIREMENTS INCLUDING WIRELESS

CROSS-REFERENCE TO RELATED APPLICATION

This application claims priority to earlier filed provisional application No. 61/711,320 filed Oct. 9, 2012 and entitled "METHOD AND SYSTEM FOR LOW BIT RATE ENCODING AND DECODING INCLUDING WIRELESS", and provisional application No. 61/714,840 filed Oct. 17, 2012 and entitled "METHOD AND SYSTEM FOR LOW BIT RATE ENCODING AND DECODING INCLUDING WIRELESS "METHOD AND SYSTEM FOR LOW BIT RATE ENCODING AND DECODING INCLUDING WIRELESS", and this application is a continuation in part of application Ser. No. 12/070,090 filed Feb. 15, 2008, now issued U.S. Pat. No. 7,970,607 issued on Jun. 28, 2011, entitled "METHOD AND SYSTEM FOR LOW BIT RATE VOICE ENCODING AND DECODING APPLICABLE FOR ANY REDUCED BANDWIDTH REQUIREMENTS INCLUDING WIRELESS", which is a continuation in part of application Ser. No. 11/055,912 filed on Feb. 11, 2005, now issued U.S. Pat. No. 7,359,853 issued on Apr. 15, 2008, entitled "METHOD AND SYSTEM FOR LOW BIT RATE VOICE ENCODING AND DECODING APPLICABLE FOR ANY REDUCED BANDWIDTH REQUIREMENTS INCLUDING WIRELESS", the entire contents of which are hereby incorporated by reference.

TECHNICAL FIELD OF THE APPLICATION

This application relates to a method and apparatus of processing speech via a voice coder/decoder (vocoder), and more specifically to using a low bit rate vocoder for increased optimization.

BACKGROUND OF THE APPLICATION

A vocoder is a speech analyzer and synthesizer. The human voice consists of sounds generated by the opening and closing of the glottis by the vocal cords, which produces a periodic waveform. This basic sound is then modified by the nose and throat to produce differences in pitch in a controlled way, creating the wide variety of sounds used in speech. There are another set of sounds, known as the unvoiced and plosive sounds, which are not modified by the mouth in said fashion.

The vocoder examines speech by finding this basic frequency, the fundamental frequency, and measuring how it is changed over time by recording someone speaking. This results in a series of numbers representing these modified frequencies at any particular time as the user speaks. In doing so, the vocoder dramatically reduces the amount of information needed to store speech, from a complete recording to a series of numbers. To recreate speech, the vocoder simply reverses the process, creating the fundamental frequency in an oscillator, then passing it into a modifier that changes the frequency based on the originally recorded series of numbers.

Disadvantageously, the actual qualities of speech cannot be reproduced so easily. In addition to a single fundamental frequency, the vocal system adds in a number of resonant frequencies that add character and quality to the voice, known as the formant. Without capturing these additional frequencies and corresponding qualities, the vocoder will not sound authentic.

In order to address this, most vocoder systems use what are effectively a number of coders, all tuned to different frequencies, using band-pass filters. The various values of these filters are stored not as raw numbers, which are all based on the original fundamental frequency, but as a series of modifications to that fundamental needed to modify it into the signal seen in the filter. During playback these settings are sent back into the filters and then added together, modified with the knowledge that speech typically varies between these frequencies in a fairly linear way. The result is recognizable speech, although somewhat "mechanical" sounding. Vocoders also often include a second system for generating unvoiced sounds, using a noise generator instead of the fundamental frequency.

Standard systems to record speech record a frequency from about 300 Hz to 4 kHz, where most of the frequencies used in speech reside, which requires 64 kbit/s of bandwidth, due to the Nyquist Criterion regarding sample rates for highest frequency. In digitizing operations, the sampling rate is the frequency with which samples are taken and converted into digital form. The Nyquist frequency is the sampling frequency which is twice that of the analog frequency being captured. For example, the sampling rate for high fidelity playback is 44.1 kHz, slightly more than double the 20 kHz frequency a person can hear. The sampling rate for digitizing voice for a toll-quality conversation is 8,000 times per second, or 8 kHz, twice the 4 kHz required for the full spectrum of the human voice. The higher the sampling rate, the closer real-world objects are represented in digital form.

Conventional low bit rate vocoders (below 4800 bits per second) use a decision process to determine if excitation is either voiced, e.g., vocal cords or unvoiced, e.g., hiss or white noise, and if voiced, a measure of the vocal pitch. The short term spectrum and the voiced pitch/unvoiced, is transmitted with a new frame approximately every 20 milliseconds via a digital link, and the reconstructed spectrum generator is excited by the pitch or white noise and speech is reproduced.

One of the disadvantages of conventional vocoders is the voice/unvoiced decision and accurate pitch estimation. For English speakers, voice quality is usually acceptable since the algorithms were developed using English speakers, but for other languages, these low bit rate vocoders do not sound natural. Higher bit rate voice excited vocoders do not require any voice/unvoiced decision or pitch tracking and preserve the intelligibility and speaker identification. The principle of operation is to encode the first formant speech band and use it to provide excitation input to the spectrum generator. Formant refers to any of several frequency regions of relatively great intensity in a sound spectrum, which together determine the characteristic quality of a vowel sound.

The vocal tract is characterized by a number of resonances or formants which shape the spectrum of the excitation function, typically three below 3000 Hertz. The first formant contains all components, both periodic (voiced) and non periodic (unvoiced) excitations.

The first formant is encoded using pulse code modulation (pcm), and then analyzing the remainder of the speech spectrum and transmitting the excitation and speech spectrum every 20-25 milliseconds. The received first formant is then decoded and is used as excitation for the spectrum generator to produce natural sounding speech. These vocoders typically use 8000 bits per second or more for natural sounding speech.

SUMMARY OF THE APPLICATION

One example embodiment of the present application may provide an apparatus that includes a receiver and a transmitter along with an encoder that includes a zero crossings calculation module configured to generate and output zero crossings of a voice sample in response to voice excitation in a first formant, and a sampling module configured to divide the output signal by two and sample at a predefined frequency such that a resulting combination uses half of a bit rate for an excitation signal and a remainder for short term spectrum analysis.

Another example embodiment may provide a method that includes receiving a voice sample, generating zero crossings of the voice sample in response to voice excitation in a first formant and creating a corresponding output signal, dividing the output signal by two, and sampling the output signal at a predefined frequency such that a resulting combination uses half of a bit rate for an excitation signal and a remainder for short term spectrum analysis.

4800 Bits Per Second Synchronous.

The present application uses voice excitation, eliminating the voice/unvoiced pitch tracking, and the first formant up to 2400 Hertz, does not use pulse code modulation encoding, but uses the zero crossings only of the first formant, dividing by two and sampling at 2400 Hertz. The resulting combination uses half of the bit rate for excitation and the remainder for short-term spectrum analysis. The frame is updated each 20 milliseconds using 49 bits for spectrum and 49 excitation bits with one synchronization bit per frame. This technique provides high intelligibility with good speaker recognition. The decoder extracts the excitation, multiplies it by two and uses a Hanning modified sawtooth and spectral flattening to excite the spectrum generator. This waveform produces both even and odd harmonics for both periodic (voiced) and aperiodic (unvoiced) frequencies and gives naturalness to all languages and speakers.

5760 Bits Per Second Asynchronous.

The 5760 bits per second Asynchronous mode utilizes the 4800 bits per second synchronous and includes a converter to add start and stop bits each eight bits giving an asynchronous rate of 5760 bits per second. At the receiver a converter takes the 5760 bits per second and removes the start and stop bits. The decoder. after start and stop bits are removed, then is the same as the 4800 bits per second Synchronous.

4800 Bits Per Second Asynchronous.

The present application uses voice excitation, eliminating the voice/unvoiced pitch tracking, and the first formant up to 1600 Hertz. The range of frequencies for the first formant is around 900 Hz to around 1600 Hertz with around 1000 Hz usually, but not always being a limit. In other embodiments, the range of frequencies for the first formant are lower than the above described range or are higher than then above described range. It does not use pulse code modulation encoding, but uses the zero crossings only of the first formant, dividing by two and sampling at the formant cutoff frequency. The resulting combination uses a bit rate equal to the formant frequency for excitation and the remainder for short-term spectrum analysis. Each frame is updated every 21.25 milliseconds using 49 bits for spectrum and 34 excitation bits with one synchronization bit per frame giving a total of 84 bits per frame The decoder extracts the excitation, multiplies it by two and uses a Hanning modified sawtooth and spectral flattening to excite the spectrum generator. This waveform produces both even and odd harmonics for both periodic (voiced) and aperiodic (unvoiced) frequencies and gives naturalness to all languages and speakers. This technique provides high intelligibility with good speaker recognition.

In the present application, the power spectrum gain for each band of frequencies is 24 dB, if channel bandwidths are used for the short term spectrum is rectified and low pass filtered, then encoded using 4 bits for the power level. Because of the close correlation of the adjacent spectrum levels, a different type of spectrum frame encoding is used. The first 8 channels are transmitted using 4 bits each, the difference between channel 8 and 9 transmits 3 bits difference between the magnitudes. Channels, 10 through 16 use two bits difference from the previous, channels difference. An AGC or Automatic Gain Control is used to optimize the level for each speaker. The AGC can be either controlled by examining the low and high frequency band pass filters and only allowing a change in gain if the lower frequency energy is greater than higher frequency and adjust the gain over several frames or the AGC can be analog with a fast attack and slow release to change the gain levels.

At the decoder, the excitation is demultiplexed, the excitation is multiplied by two and the pulses are converted to a Hanning modified sawtooth that is spectrally flattened to give equal amplitudes to all of the harmonics and used as excitation for the spectrum generator. The gain coefficients are decoded and used to synthesize the voice. The resultant synthesis sounds natural and the intelligibility is as good as a toll quality telephone line.

Although the description of the application uses analog circuits and bandwidths to more easily describe voice excitation, the implementation can be easily realized using digital signal processing techniques and microprocessors or linear predictive spectral encoding and readily available conventional codecs.

2400 Bits Per Second.

The 2400 bits per second vocoder of the present application restricts the first formant to 300 to 1100 Hertz, and then translates the first formant down 300 Hertz to near zero frequency to 800 Hertz. It then uses the same technique of zero crossings and divide by two of the first formant, this gives a maximum of frequency of 400 Hertz. The sampling frequency then is ⅓ of the bit rate or 800 bits per second for the excitation. This leaves 1600 bits to encode the spectral information.

The spectrum frame rate is around 20 milliseconds. The frequency amplitude spectrum is encoded using either a predictive short term frequency analysis, bandpass filter channels or a Fast Fourier Transform. If bandpass channels are implemented and the correlation between spectrum amplitude frequency analysis bands is good then a difference or delta encoding is used. The spectral information uses 32 bits per frame. The first spectral band is encoded using 4 bits for amplitude, the next 12 spectral analysis bands uses 2 bits difference (either up or down) from the previous level, the last three bands use one bit difference (either up or down) from the previous level, giving 31 bits per frame for spectral information and a one frame sync bit. The excitation for each frame is around 16 bits.

At the decoder, the excitation is demultiplexed, the excitation is passed through a 450 Hertz low pass filter, multiplied by two and frequency translated to 1100 Hertz where the zero crossings are converted to the Hanning modified sawtooth that is spectrally flattened and used as excitation for the spectrum generator.

BRIEF DESCRIPTION OF THE DRAWINGS

FIG. 7 is a timing diagram showing the excitation and channel spectrum framing for 4800 bits per second synchronous as used in the present application.

DETAILED DESCRIPTION OF THE APPLICATION

An implementation of the present application includes a voice encoder and decoder method and system that uses voice excitation, eliminating the voice/unvoiced pitch tracking, and the first formant up to 2400 Hertz for synchronous and up to 1600 Hertz for asynchronous, does not use pulse code modulation encoding, but uses the zero crossings only of the first formant, frequency dividing by two and sampling at the formant frequency. The resulting combination uses half or less of the bit rate for excitation and the remainder for short-term spectrum analysis. The spectrum could be updated each 20 milliseconds using 49 bits for the spectrum frame and 49 bits for excitation and one frame bit for synchronous Asynchronous operation could be update at 21.25 milliseconds using 49 bits for the spectrum information and 34 bits for excitation with one bit for frame synchronization. The decoder extracts the excitation, multiplies it by two and uses a Hanning modified sawtooth and spectral flattening to excite the spectrum generator. This waveform produces both even and odd harmonics for both periodic (voiced) and aperiodic (unvoiced) frequencies and gives naturalness to all languages and speakers.

Figure 1:
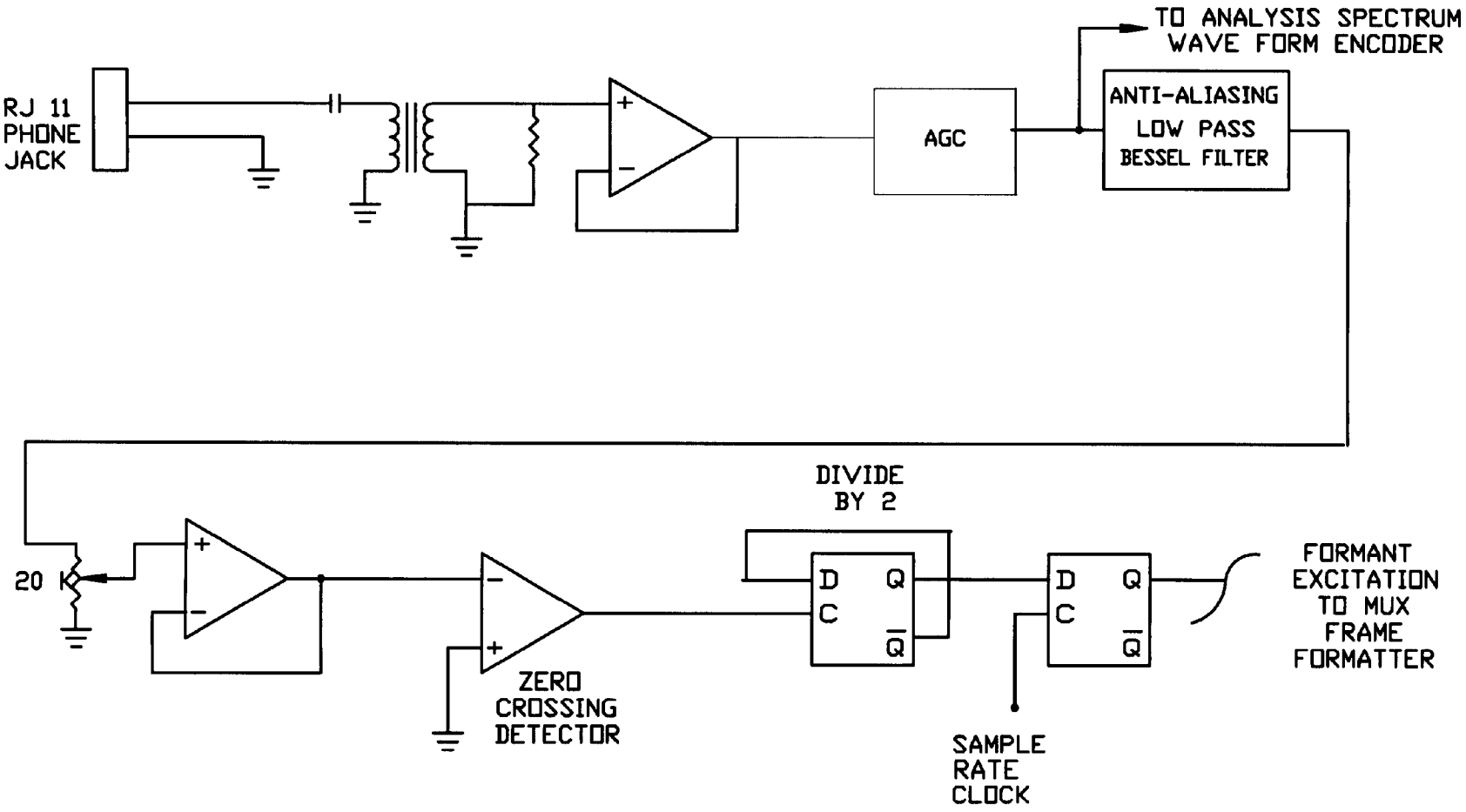
FIG. 1 is a block diagram of the first formant encoder excitation extraction and frequency divide by two operation for the 4800 bits per second vocoder implementation of the present application.

FIG. 1 is a block diagram of the first formant encoder excitation extraction and frequency divide by two operation for the 4800 bits per second synchronous and asynchronous vocoder implementation of the present application. As seen therein, transformer 100 isolates an audio input, such as a telephone line with a typical impedance of 600 ohms. The input could be a microphone or other type of speech input. Buffer amplifier 102 isolates the input from the device. Automatic gain control 103 adjusts the long-term gain for each level of input. Automatic gain control 103, either a digital or analog device, also could be a device that uses only voiced (vocal tract) decisions to adjust the long-term audio level. Anti-aliasing filter 104 removes frequencies higher than one half of the sampling rate. The filter response could be implemented as a Bessel filter or could also be implemented using other techniques such as elliptic function (Cauer) followed by an all pass to give a flat group delay. The envelope delay should be the same for all frequencies in the pass band. Variable gain device 105 consists of a potentiometer and a buffer amplifier and is used to set the level for zero crossing detector 106. Zero crossing detector 106 is referenced to zero volts and has an output that is compatible with the type of digital logic voltage levels. Zero crossings give basic excitation frequencies that are used to derive speech modeling. Bistable multivibrator 107 divides the basic zero crossing frequencies by two. Although a "D" flip flop 108 is shown, "JK" flip flops or other types can be used. "D" type register 108 is used to store the output of 107 and is clocked at the sample rate which is a sub multiple of the synchronous clock. The output of "D" flip flop 108 is sent to the multiplexer frame formatter where it is transmitted continuously as part of the data stream and is independent of the spectrum amplitude. As seen in FIG. 1, the filtering, zero crossing and divide by two and sampling at a sub multiple of the synchronous channel clock allows voice excitation to be sent at lower bit rates than other similar voice encoders.

Figure 2:
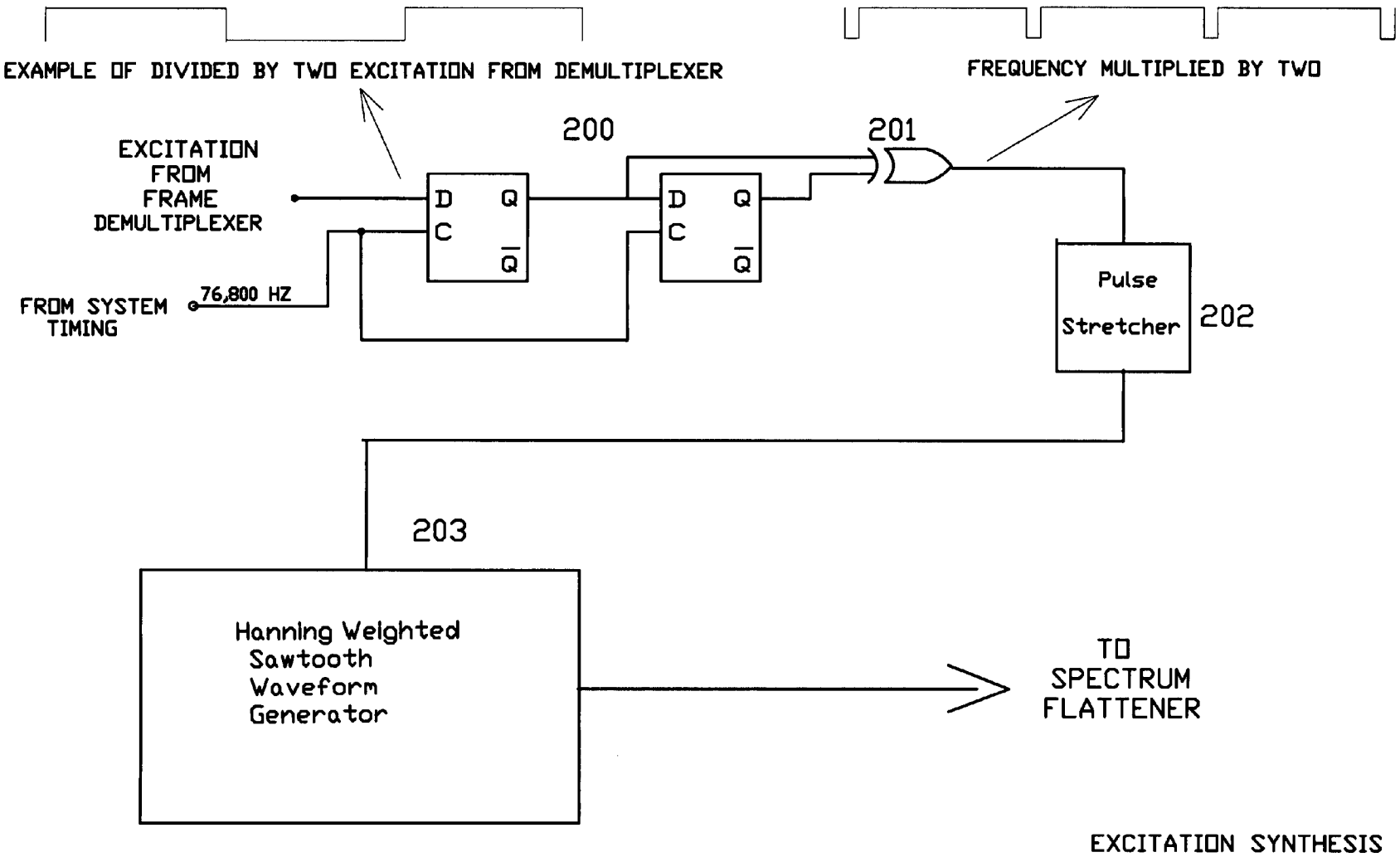
FIG. 2 is a block diagram of the decoder excitation and frequency multiplied by two operation for the first formant and the excitation weighting function for 4800 bits per second vocoder implementation of the present application.
Figure 12:
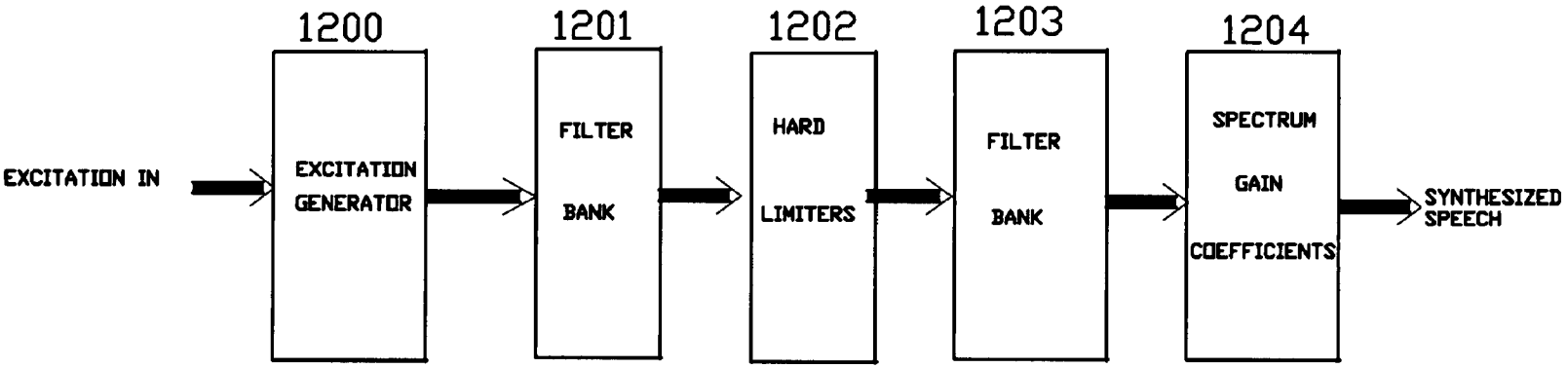
FIG. 12 shows a block diagram of a method of spectral flattening of the excitation in a channel vocoder of the present application.

FIG. 2 is a block diagram of the decoder excitation and frequency multiplied by two operation for the first formant and the excitation weighting function for 4800 bits per second synchronous or asynchronous vocoder implementation of the present application. As seen therein, excitation synthesis, the excitation divided by two is sent from the frame demultiplexer to "two bit" shift register 200 that could be either "D" or "JK" flip flop and clocked at a much higher rate than the data clock. The output from each register is connected to a device such as an "exclusive or" device 201 which gives an output at each edge either positive or negative and thus gives a frequency that is twice the input frequency which restores the original zero crossing frequencies. If analog detection is used, a differentiator with either the negative or positive peaks could be used. The output of the frequency multiplier, comprising "two bit" shift register 200 and "exclusive or" device 201 is then sent to pulse stretcher 202 which could be a one-shot multivibrator. The output of pulse stretcher 202 is then sent to a Hanning weighted sawtooth waveform generator 203 where the output from pulse stretcher 202 is used to generate a sawtooth waveform that is multiplied by a raised cosine or Hanning weighted function that also is modified to eliminate any direct current components. The sawtooth wave more closely models the vocal tract excitation and also includes both even and odd harmonics. The output is sent to a spectral flattener, which gives equal amplitudes to all harmonics of the voice excitation. The spectral flattener is a key component of voice coding techniques, and can be constructed as shown in FIG. 12 or could be the outputs of a bank of filters with a fast attack automatic gain control, or the sign bit or most significant bit of an output of a digital filter.

Figure 3A:
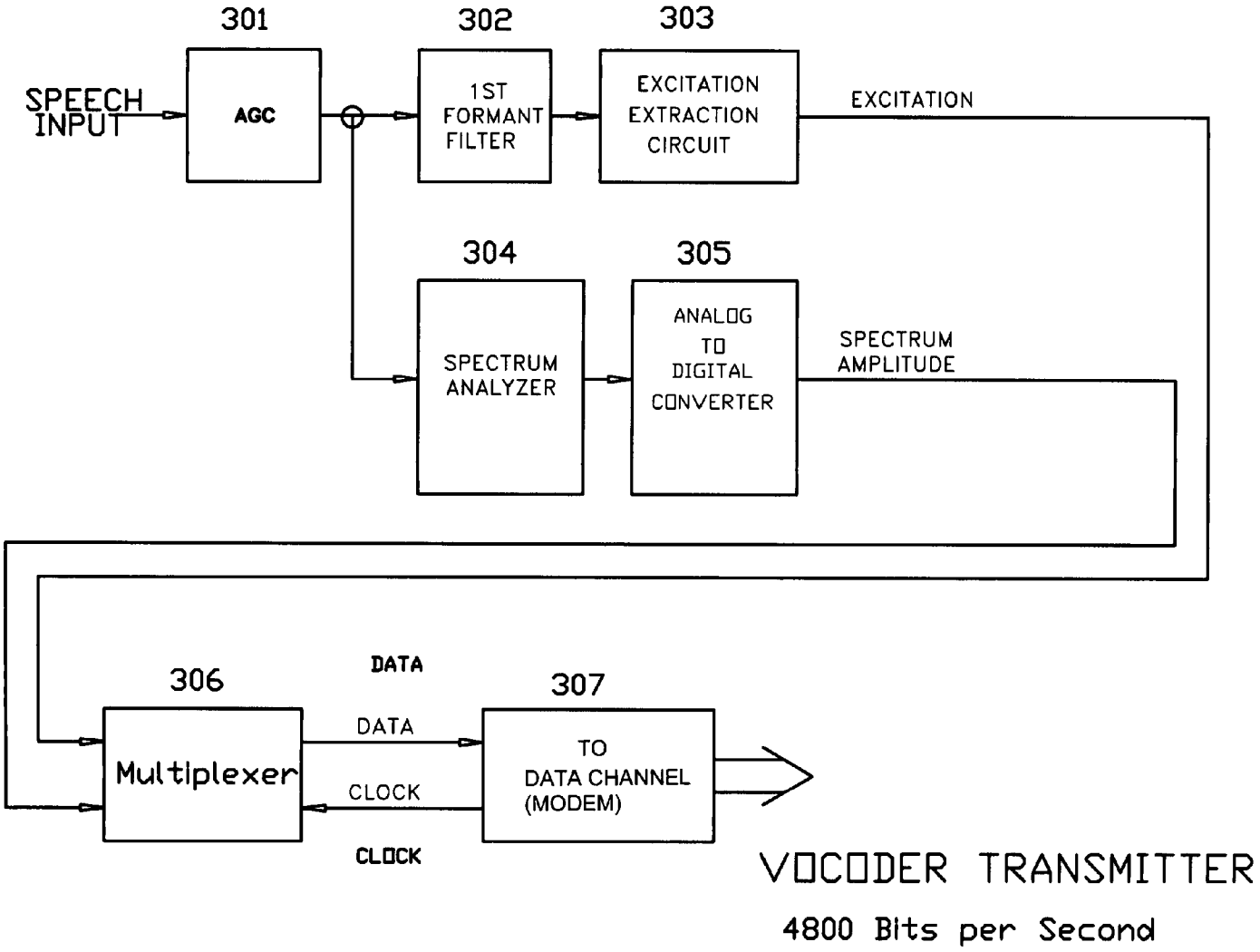
FIG. 3A is a block diagram of the 4800 bits per second vocoder transmitter implementation of the present application using the first formant zero crossing and divide by two and non channel short term spectrum.

FIG. 3A provides a block diagram for a 4800 bits per second synchronous or asynchronous vocoder transmitter implementation of the present application, which could be a non-channel vocoder. Automatic gain control 301, which can be either digital or analog, adjusts the long-term gain for each level of input. It also could be a device that uses only voiced (vocal tract) decisions to adjust the long-term audio level. First formant filter 302 can be based upon a Bessel (flat envelope delay) realization and could be implemented as an analog or digital device. Circuit module 303 implements the excitation analysis of FIG. 1. Spectrum analyzer 304 provides a short-term frequency spectrum for the typical telephone line bandwidth of 300 to 3000 Hertz. The output of the spectrum analyzer 304 is converted by ADC 305 into a 4 bit amplitude for either frequency bands or a linear predictive code. Multiplexer 306 combines the excitation and short-term spectrum into a single data stream that is clocked by the synchronous data channel 307. Synchronous or asynchronous data channel 307 can be either a wireless or to a digital channel.

Figure 3B:
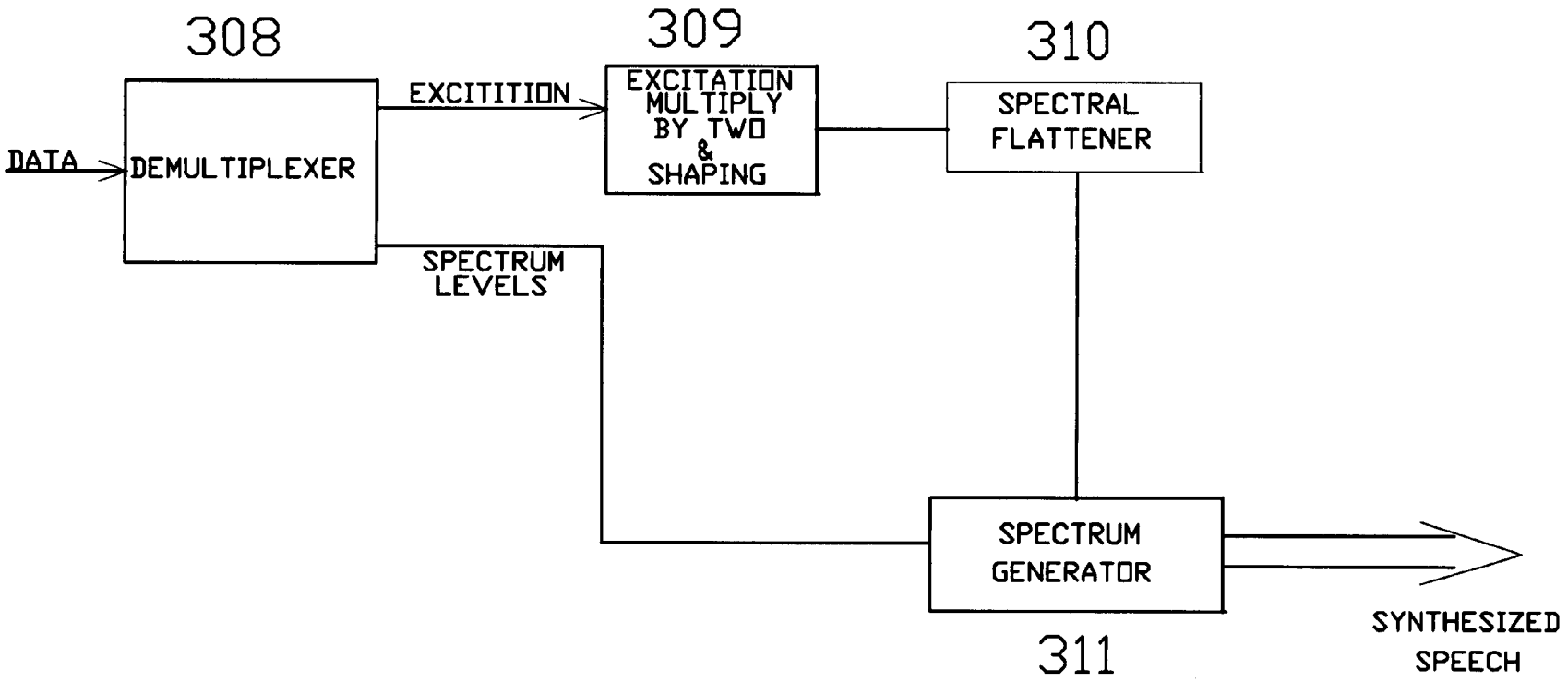
FIG. 3B is a block diagram of a 4800 bits per second vocoder receiver implementation of the present application using the multiply by two excitation extraction and non channel short term spectrum operation.

FIG. 3B is a block diagram of a 4800 bits per second vocoder receiver implementation of the present application using the multiply by two excitation extraction and non channel short term spectrum. The receiver is a 4800 bits per second vocoder receiver which could be a non-channel vocoder. Demultiplexer 308 separates the excitation from the short-term spectrum weighting. Module 309 is adapted to perform the excitation synthesis shown in FIG. 2. Spectral flattener 310 flattens the spectrum to give equal amplitudes to all harmonics. Spectrum generator 311 takes the spectrum weighting excited by module 309 and synthesizes speech.

Figure 4:
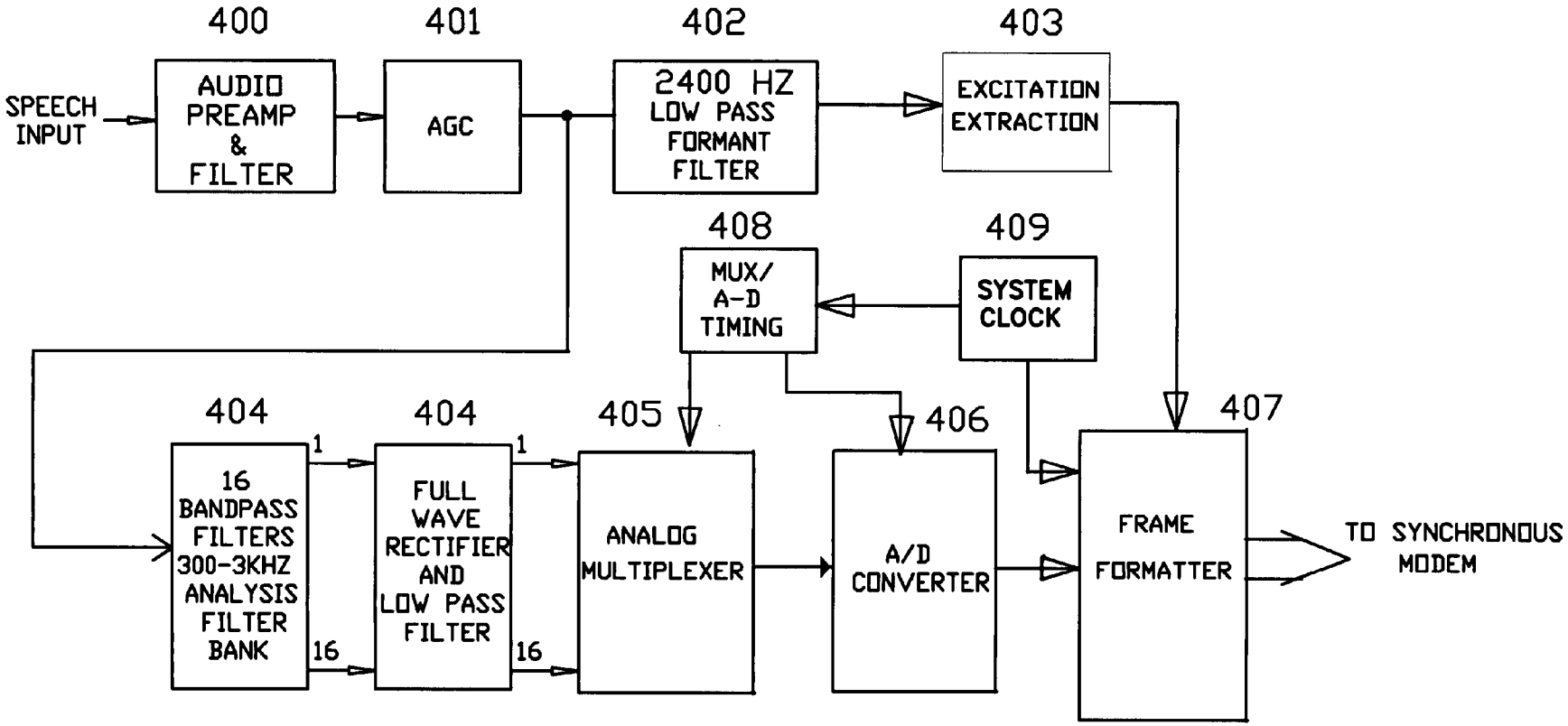
FIG. 4 is a block diagram of the 4800 bits per second channel vocoder encoder implementation of the present application using the first formant extraction, band pass filters, rectification and filtering and analog to digital conversion of the power spectral density and frame formatter.

FIG. 4 is a block is a block diagram of a synchronous 4800 bits per second channel vocoder implementation of the present application illustrating the first formant excitation, channel filters, band pass spectrum power density, analog to digital conversion and multiplexing of the excitation and spectral power density to a synchronous modem channel. As seen therein, module 400 comprises a preamplifier and a band pass filter that limits the input frequencies to 300 Hertz to 3000 Hertz. Automatic gain control 401, either a digital or analog device, adjusts the long-term gain for each level of input. Automatic gain control 401 could be a device that uses only voiced (vocal tract) decisions to adjust the long-term audio level. Up to 2400 low pass filter 402 has a Bessel flat delay response and is used to limit the frequencies to the excitation extraction module 403 (as seen as modules 106 through 108 in FIG. 1). Filter module 404 consists of 16 Bessel response band pass filters that give overlapping coverage from 300 Hertz to 3000 Hertz. Filter module 404 comprises 16 rectifiers and 16 low pass filters operable to provide a dc voltage that represents the power spectral density of each band pass. The low pass filter of filter module 404 comprises a first order low pass that is matched to the frame rate Multiplexer 405 sequentially switches between all 16 channels and controls the start of conversion for a four bit analog to digital converter 406. Each channel's four-bit amplitude is stored in a register located in frame formatter 407. Channels 1 through 8 are encoded as the full 4 bits. Frame formatter 407 includes a 4-bit magnitude comparator that compares channel 8 and channel 9 and the 3 most significant bits are encoded. Channel 10 through 16 is compared using the difference between the previous channel and the two most significant bits are encoded. The frames consist of 50 bits for spectrum amplitudes where one bit is for frame synchronization and 49 bits are used for excitation. The frame rate is 20 milliseconds for synchronous as explained in the description of FIG. 7.

Figure 4A:
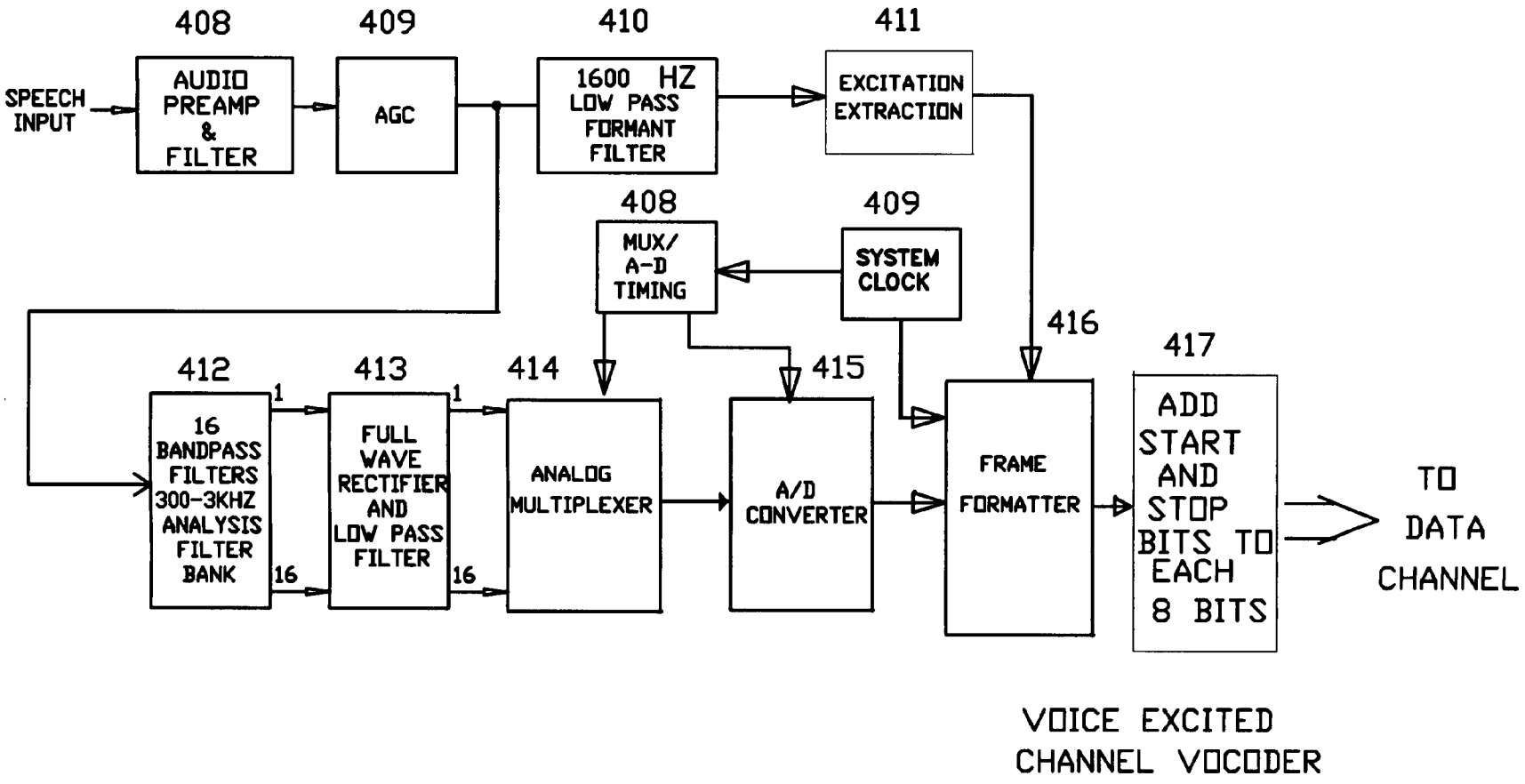
FIG. 4A a block diagram of the 4800 bits per second asynchronous channel vocoder encoder implementation of the present application using the first formant extraction, band pass filters, rectification and filtering and analog to digital conversion of the power spectral density and frame formatter.

FIG. 4A is a block is a block diagram of an asynchronous 4800 bits per second channel vocoder implementation of the present application illustrating the first formant excitation, channel filters, band pass spectrum power density, analog to digital conversion and multiplexing of the excitation and spectral power density to a synchronous modem channel. As seen therein, module 408 comprises a preamplifier and a band pass filter that limits the input frequencies to 300 Hertz to 3000 Hertz. Automatic gain control 409, either a digital or analog device, adjusts the long-term gain for each level of input. Automatic gain control 409 could be a device that uses only voiced (vocal tract) decisions to adjust the long-term audio level. Up to 1600 Hertz for low pass filter 410 has a Bessel flat delay response and is used to limit the frequencies to the excitation extraction module 411 (as seen as modules 106 through 108 in FIG. 1). Filter module 412 consists of 16 Bessel response band pass filters that give overlapping coverage from 300 Hertz to 3000 Hertz. Filter module 413 comprises 16 rectifiers and 16 low pass filters operable to provide a dc voltage that represents the power spectral density of each band pass. The low pass filter of filter module 413 comprises a first order low pass that is matched to the frame rate Multiplexer 414 sequentially switches between all 16 channels and controls the start of conversion for a four bit analog to digital converter 415. Each channel's four-bit amplitude is stored in a register located in frame formatter 418. Channels 1 through 8 are encoded as the full 4 bits. Frame formatter 416 includes a 4-bit magnitude comparator that compares channel 8 and channel 9 and the 3 most significant bits are encoded. Channel 10 through 16 is compared using the difference between the previous channel and the two most significant bits are encoded. The frames consist of 50 bits for spectrum amplitudes where one bit is for frame synchronization and 34 bits are used for excitation. The frame rate is 21.5 milliseconds for asynchronous as previously explained. Module 417 adds start and stop bits to each 8 bits as explained in FIG. 7A.

Figure 5:
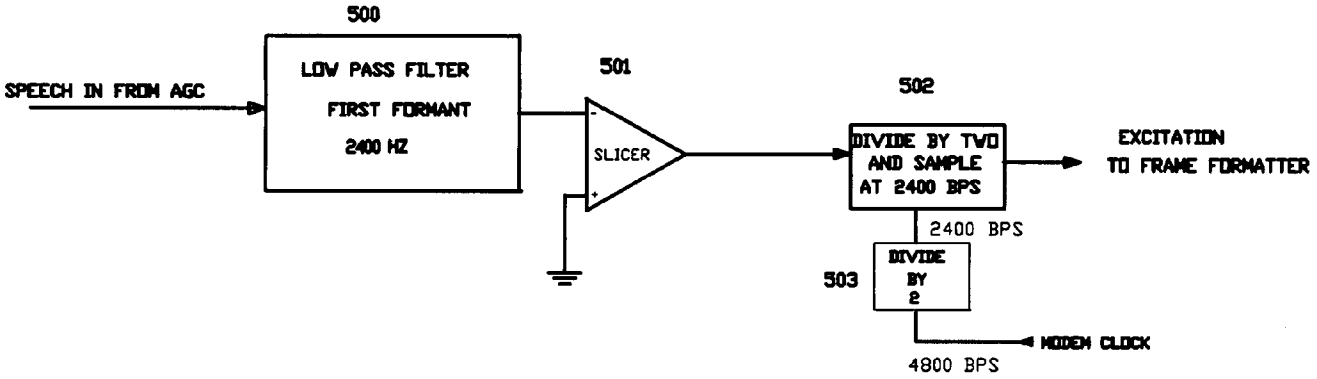
FIG. 5 is a block diagram showing the excitation extraction at 4800 bits per second synchronous and the modem clock divided by two to provide sampling of the zero crossings divided by two.

FIG. 5 is a block diagram illustrating the excitation extraction at 4800 bits per second and the modem clock divided by two operations, which to provides sampling of the zero crossings divided by two. As seen therein, 2400 Hertz Bessel response low pass filter 500 is followed by zero crossing detector (also referred to as a slicer) 501 which compares the signal to zero volts. Module 502 comprises a divide by two digital flip flop and a digital "D" flip flop where the excitation clock is the modem or channel clock divided by two. The output is sent to the frame formatter 407 as seen in FIG. 4. The excitation rate for a 4800 bits per second channel then is 2400 or ½ of the channel rate.

Figure 5A:
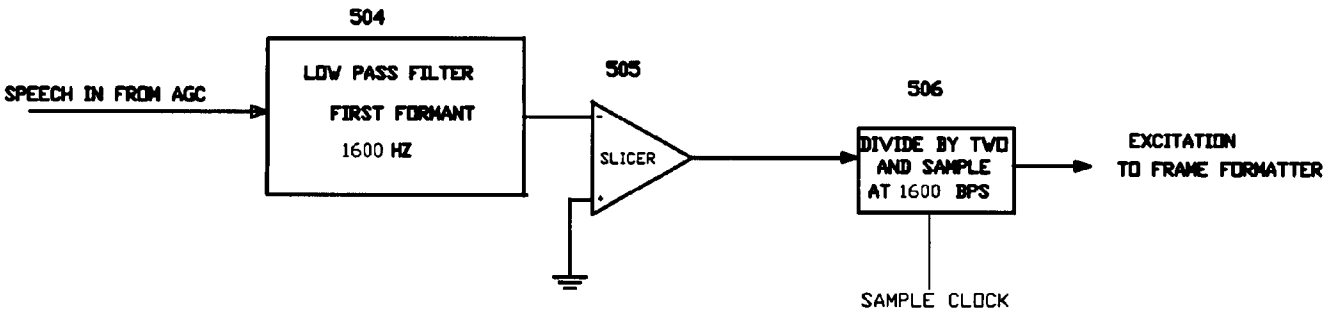
FIG. 5A is a block diagram showing the excitation for 4800 bits per second asynchronous and using a 1600 Hz clock for the sample clock.

FIG. 5A is a block diagram illustrating the excitation extraction and asynchronous 1600 clock operation which provides sampling of the zero crossings divided by two. As seen therein, 1600 Hertz Bessel response low pass filter 504 is followed by zero crossing detector (also referred to as a slicer) 505 which compares the signal to zero volts. Module 506 comprises a divide by two digital flip flop where the excitation clock is the channel clock. The output is sent to the frame formatter 407 as seen in FIG. 4. The excitation rate for a 4800 bits per second channel asynchronous then is 1600 Hz.

Figure 6:
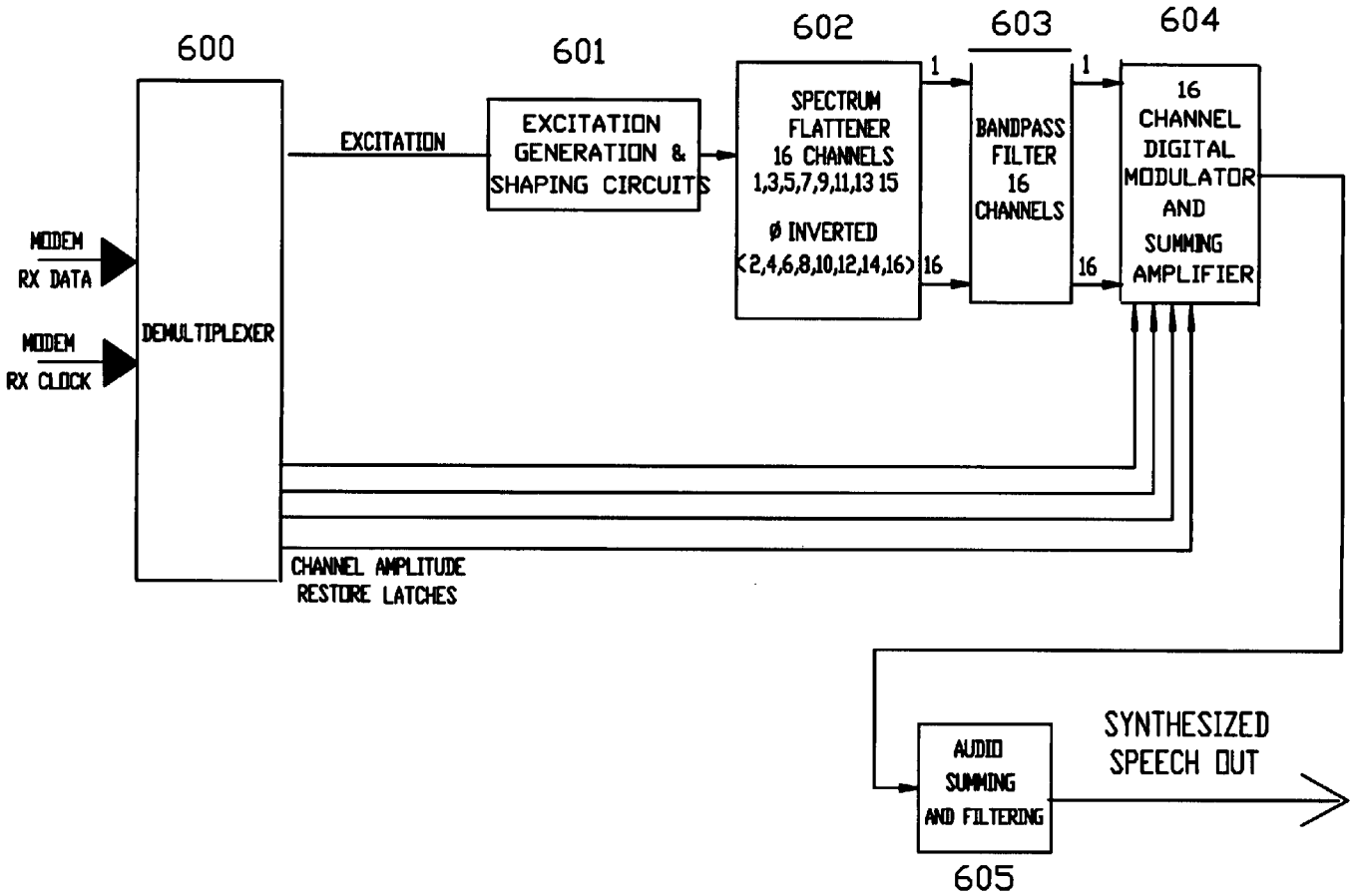
FIG. 6 is the block diagram for the 4800 bits per second voice excited channel vocoder synchronous receiver implementation of the present application.

FIG. 6 is the block diagram for the 4800 bits per second synchronous voice excited channel vocoder receiver implementation of the present application. As seen therein, demultiplexer 600 is a voice excited channel vocoder receiver or synthesizer that separates the excitation from the spectrum amplitude clock from a 4800 bits per second channel and sends the excitation delayed by one frame to "two bit" shift register 200 as seen in FIG. 2. Spectral flattener 602 is operable to give equal amplitude to all harmonics of the excitation. It can either consist of a bank of channel filters identical to the analyzer followed by hard limiters followed by an identical bank of filters 603, or can be simplified by using only a single bank of filters followed by 16 automatic gain control devices. Digital modulator 604 restores the synthesized frequencies from the spectral flattener and sends them to audio summing and filtering module 605 which sums them together to synthesize the speech.

Figure 6A:
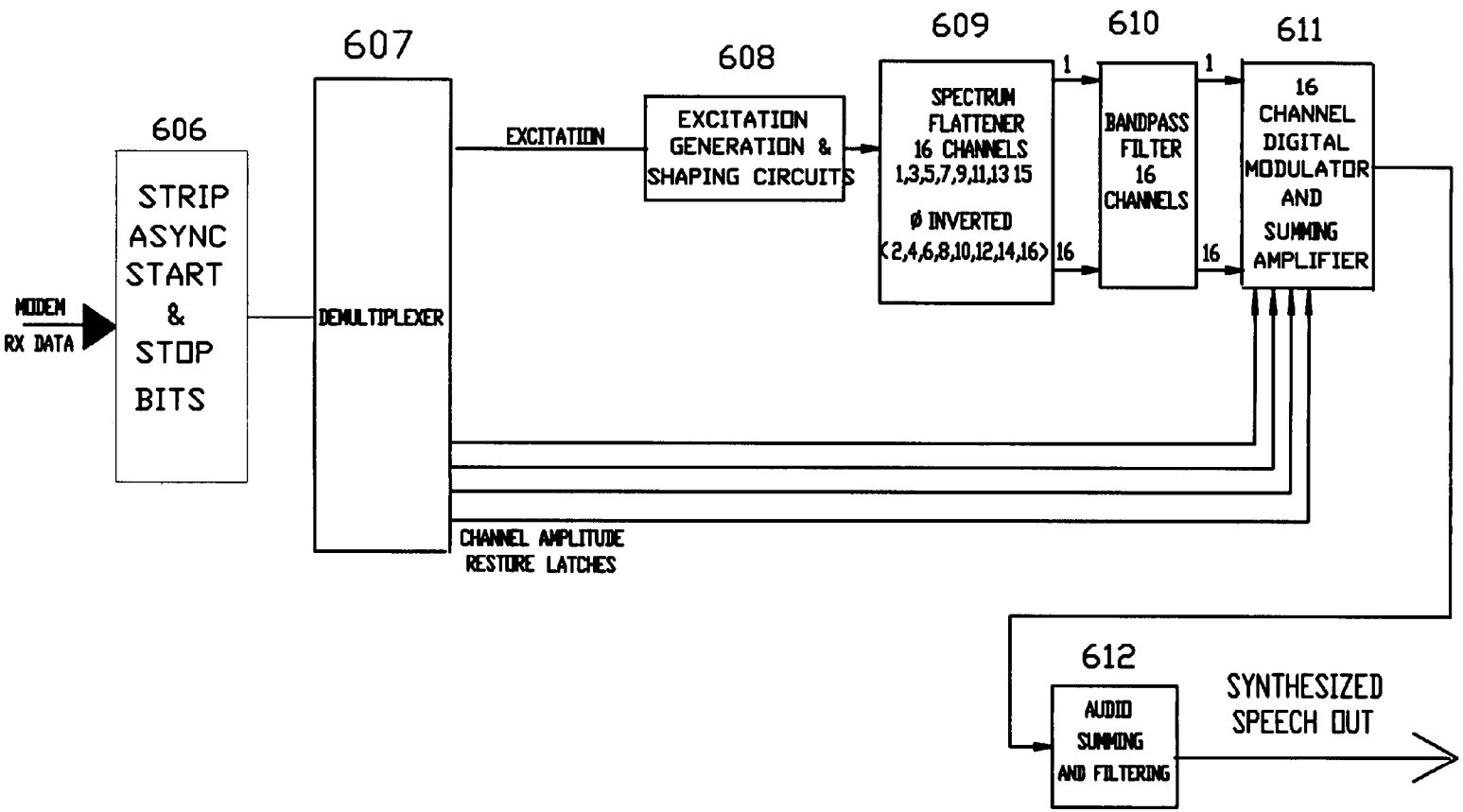
FIG. 6A is a block diagram for the 4800 bits per second voice excited channel vocoder asynchronous receiver implementation of the present application.

FIG. 6A is the block diagram for the 4800 bits per second asynchronous voice excited channel vocoder receiver implementation of the present application. As seen therein, block 606 strips the start and stop bits from the received data, the demultiplexer 607 that separates the excitation from the spectrum amplitude from a 4000 bits per second channel and sends the excitation delayed by one frame to "two bit" shift register 200 as seen in FIG. 2. Spectral flattener 609 is operable to give equal amplitude to all harmonics of the excitation. It can either consist of a bank of channel filters identical to the analyzer followed by hard limiters followed by an identical bank of filters 610, or can be simplified by using only a single bank of filters followed by 16 automatic gain control devices. Digital modulator 611 restores the synthesized frequencies from the spectral flattener and sends them to audio summing and filtering module 612 which sums them together to synthesize the speech.

FIG. 7 is a timing diagram showing the excitation and channel spectrum framing for 4800 bits per second synchronous. As seen therein, the clock from the channel (modem or wireless) is shown as clock. The clock samples the data (on the negative transitions) and transfers the data to the channel. The excitation is every other data bit and is continuous. The third line shows the encoding for the spectrum. Bit zero is the frame synchronization bit and is used to synchronize the spectrum amplitudes for the different channels if band pass channels are used, linear prediction or residuals could also use the same format. 49 bits are used for the short term power spectrum encoding giving a frame of 50 bits which includes the synchronizing bit. The excitation is ½ of the data rate and is continuous, the spectral envelope is updated every 20 milliseconds.

Figure 7A:
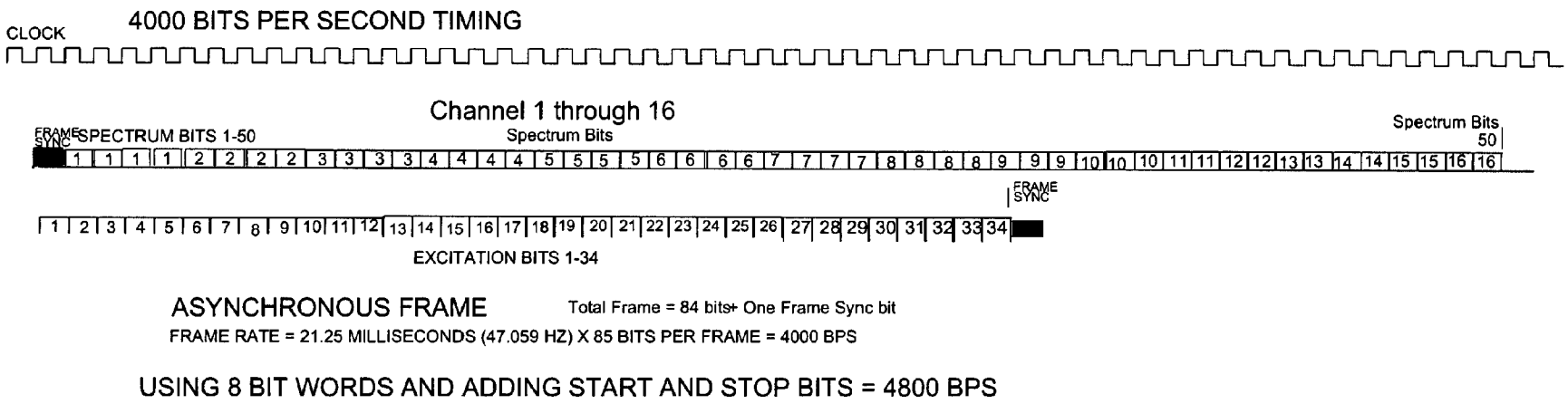
FIG. 7A is a timing diagram showing the excitation and channel spectrum framing for 4800 bits per second asynchronous as used in the present application.

FIG. 7A is a timing diagram showing the excitation and channel spectrum framing for 4800 bits per second asynchronous. As seen therein, the clock is an internally generated clock running at 4000 bits per second. The clock samples the data (on the negative transitions) and transfers the data to the channel. The spectrum channel encoding is shown on line 2. The excitation encoding is shown on line 3 and uses 34 bits. Bit zero is the frame synchronization bit and is used to synchronize the spectrum channel amplitudes if band pass filters are used. Linear prediction or residuals could also use a similar format. 49 bits are used for the short term power spectrum encoding giving a spectrum frame of 50 bits which includes the synchronizing bit. The excitation using 34 bits is also included in each frame giving a total frame of 84 bits. Adding start and stop bits to each 8 bit words gives a 4800 bits per second output.

Figure 8:
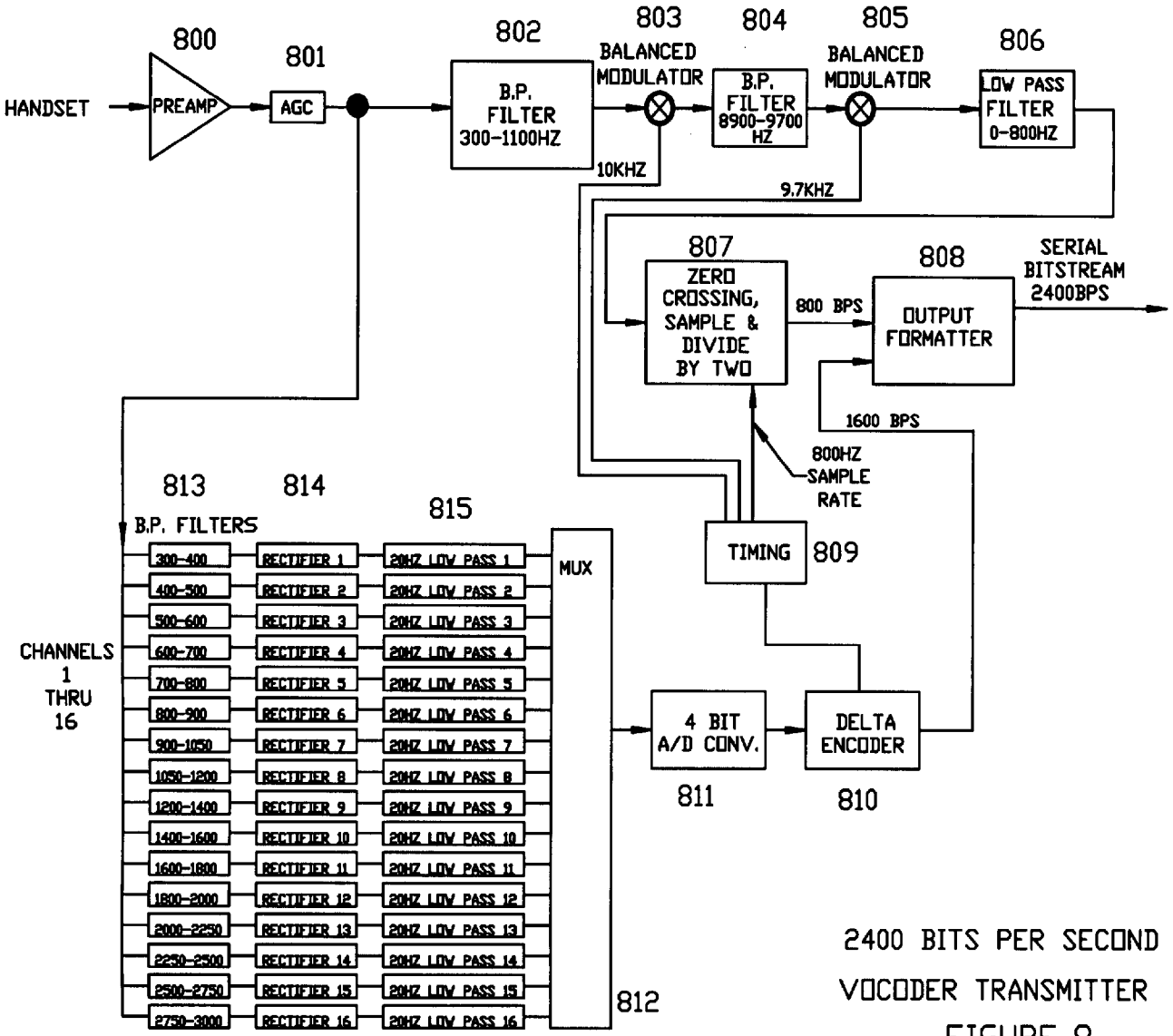
FIG. 8 is a block diagram of the 2400 bits per second channel vocoder transmitter implementation of the present application using the first formant zero crossing and divide by two.

FIG. 8 is a block diagram of the 2400 bits per second channel vocoder transmitter implementation of the present application using the first formant zero crossing and divide by two. As seen therein, the diagram shows frequency translation of the first formant (300 to 1100 Hertz) to zero to 800 Hertz, dividing by two and sampling at 800 Hertz for the excitation, and using a bank of band pass filter, rectifying lows pass filtering to give the power spectral density, converting the outputs to a four bit digital conversion, encoding the amplitude difference between channels, and multiplexing the excitation and spectral levels to provide a serial data output of 2400 bits per second. Preamplifier 800 is operable to condition the level of the voice input. Automatic gain control 801, either a digital or analog device, adjusts the long term gain for each level of input. It also could be a device that uses only voiced (vocal tract) decisions to adjust the long term audio level. Filter 802 is a 300 to 1100 Hertz low pass filter with a Bessel response. A first balanced modulator 803 is a double balanced modulator that cancels the 10 kHz and the 300 to 1100 Hertz inputs and gives both the sum and difference of the input frequencies. (8900 to 9700 Hertz, and 10300 to 11100 Hertz). Bandpass filter 804 is a band pass filter with a Bessel response and bandwidth of 8900 to 9700 Hertz. A second balanced modulator 805 generates the difference sideband of 0 to 800 Hertz which is filtered by Bessel response low pass filter 806. Module 807 (comprising zero crossing detector 106 and bistable multivibrator 107 of FIG. 1) divides the basic zero crossing frequencies by two and the sampled data at 800 Hertz is encoded by output formatter 808. Timing module 809 provides digital timing based on an oscillator frequency of 2.457600 Mega Hertz and synchronized with the clock from the channel. Bandpass filters 813 comprise a bank of 16 band pass filters with Bessel responses, whose outputs are converted by rectifiers 814 filters 815 to the power spectral density of the voice input. Multiplexer 812 is an analog multiplexer that allows converter 811, a four bit analog to digital converter to change to analog outputs to digital. Encoder 810 is a delta encoder that uses the channel to channel correlation of the short term power spectrum to send after channel one, only difference codes to output formatter 808, as further described in FIG. 11.

Figure 9:
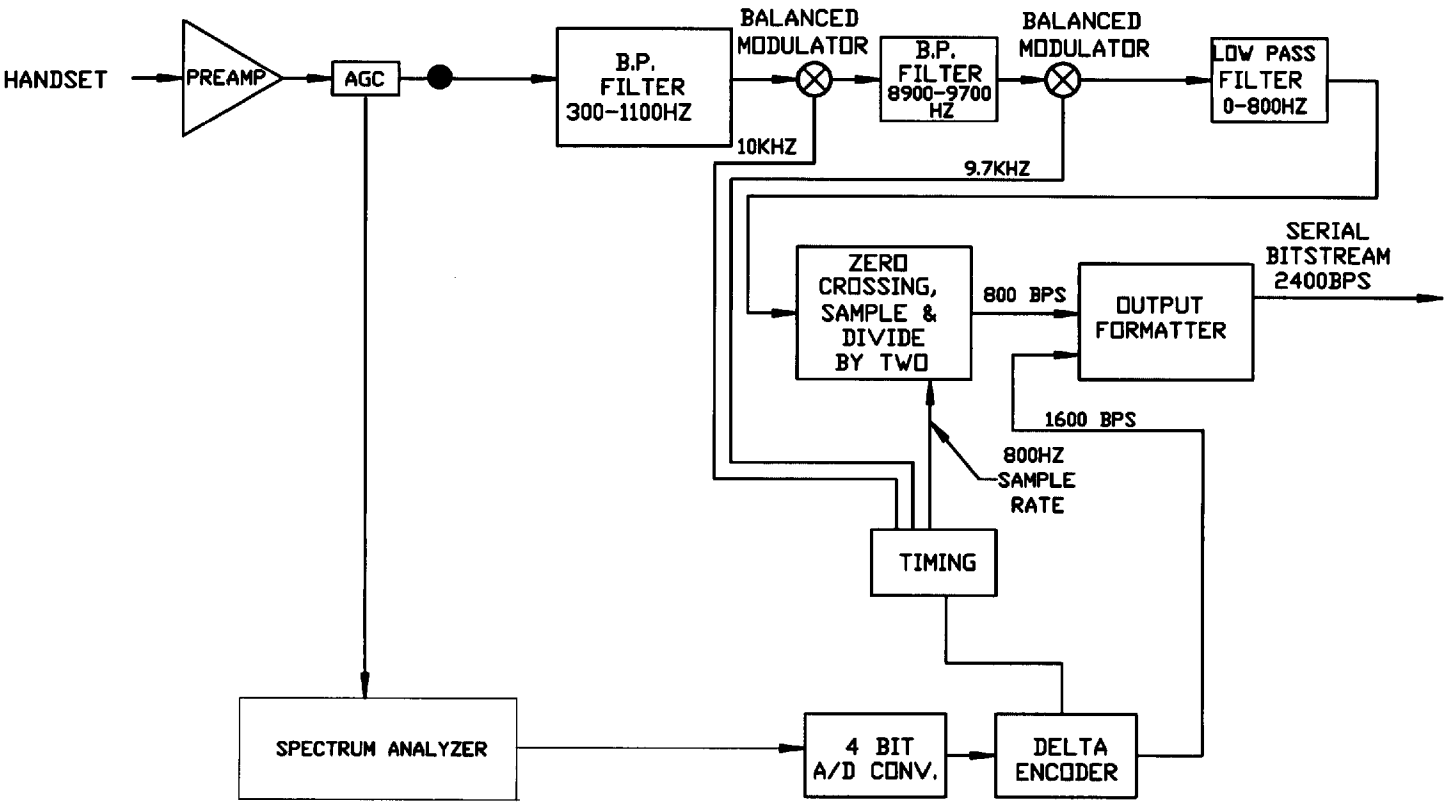
FIG. 9 is a block diagram of a 2400 bits per second vocoder transmitter implementation of the present application using the excitation and translation, but a non channel spectrum analyzer.

FIG. 9 is a block diagram of a 2400 bits per second vocoder transmitter implementation of the present application using the excitation and translation, but a non channel spectrum analyzer. As seen therein, this block diagram shows an example of a 2400 bits per second vocoder using other than band pass filters to encode the short term power spectrum. The frequency translation and excitation is the same as in FIG. 8.

Figure 10:
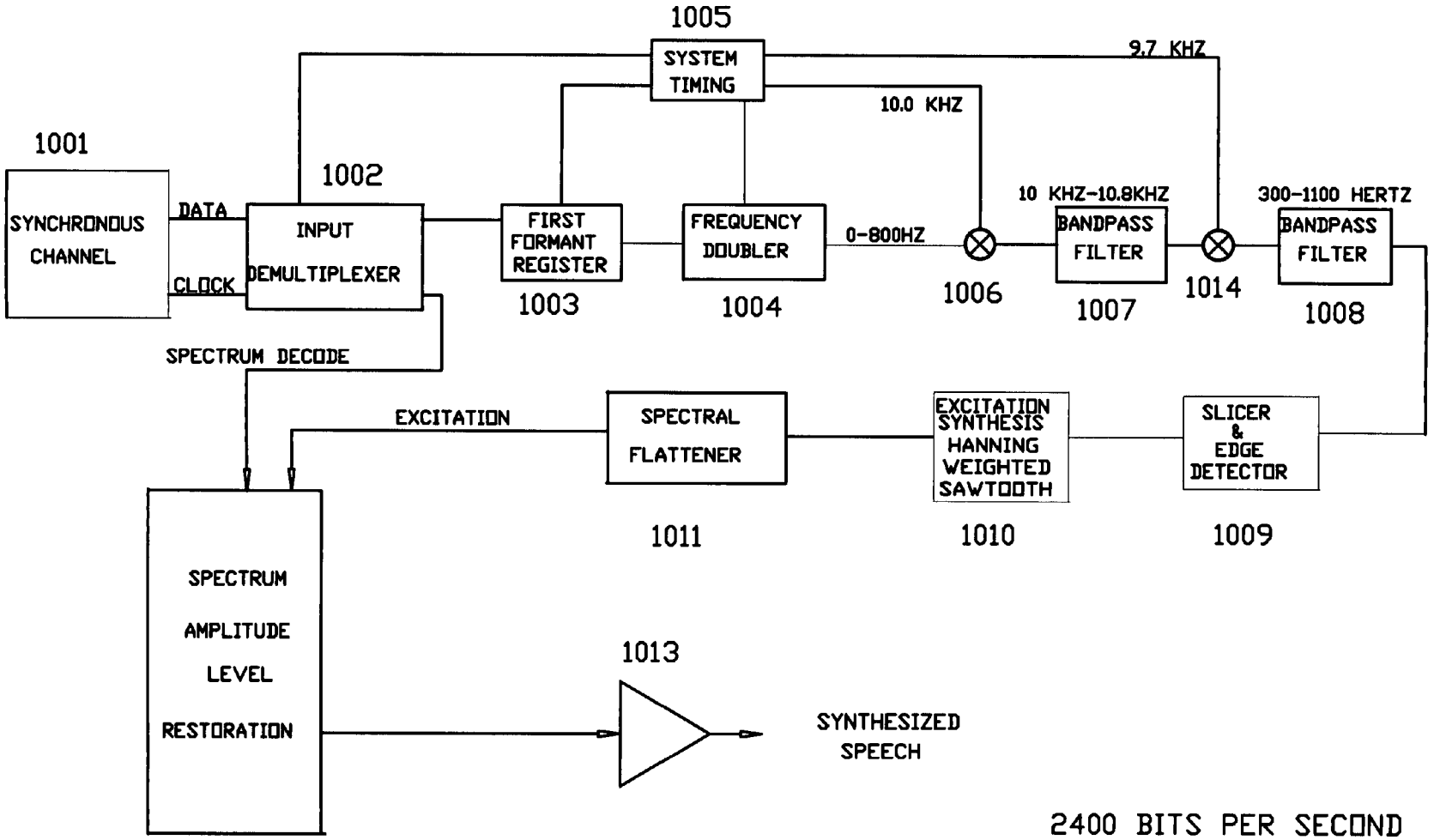
FIG. 10 is a block diagram of a 2400 bits per second vocoder receiver implementation of the present application using frequency translation and excitation.

FIG. 10 is a block diagram of a 2400 bits per second vocoder receiver implementation of the present application using frequency translation and excitation. Channel 1001 could be a synchronous wireless or radio modem or a wired channel. Demultiplexer 1002 takes the serial data and separates excitation and power spectrum encoding. Register 1003 stores the serial excitation and outputs it to frequency doubler 1004 which doubles the frequency using the same technique as described in the discussion of FIG. 2. The output of frequency doubler 1004 is an input to a first balanced modulator 1006, which is a double balanced modulator with a multiplying frequency of 10 kilohertz. Filter 1007 is a Bessel response band pass filter with a bandwidth of 10 to 10.8 kilo Hertz. The lower sideband of 10 to 10.8 kilohertz is selected and sent to a second balanced modulator 1014, which is also a double balanced modulator with a multiplication frequency of 9.7 kilo Hertz. The lower sideband (300 to 1100 Hertz) is then filtered by item 1008 a band pass filter with Bessel response where the output is passed to item 1009 which takes the zero crossings which are then changed by module 1010 to a sawtooth waveform that is modified by a Hanning weighting which removes and DC components and gives both even and odd harmonics which then goes to spectral flattener 1011 which gives flat amplitudes to all excitation frequencies. Module 1012 restores the original spectrum using the same encoding/decoding as further described by FIG. 11. The outputs are summed and the synthesized speech is provided to amplifier 1013, the output sound amplifier. System timing module 1005 times the system based on an oscillator frequency of 2.457600 Megahertz.

Figure 11:
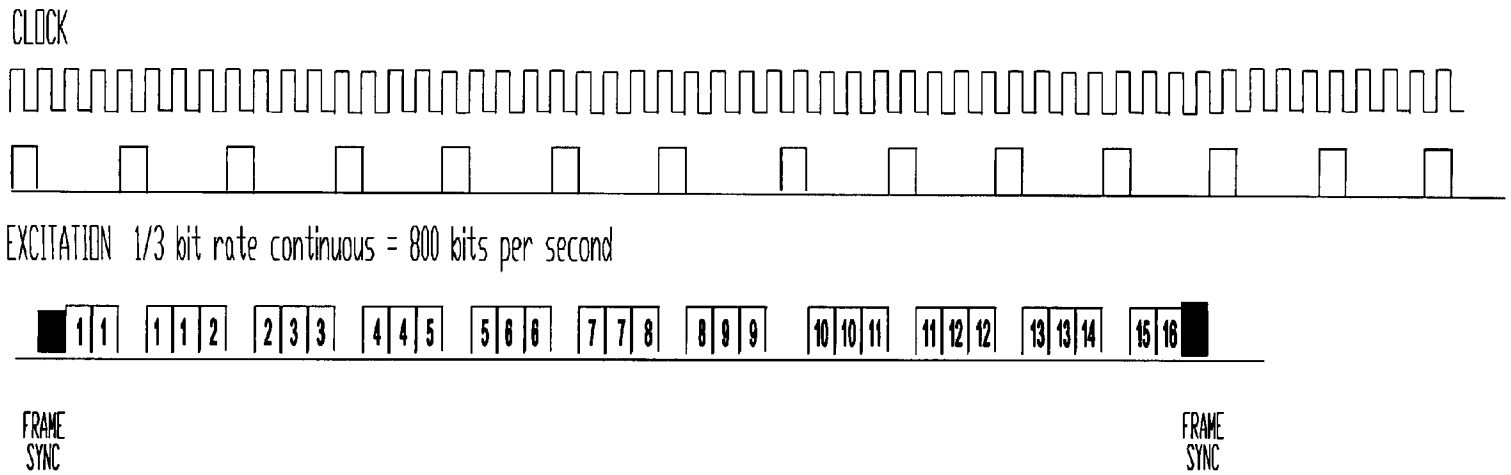
FIG. 11 is the timing diagram for the excitation and spectrum framing for a 2400 bits per second channel vocoder of the present application.

FIG. 11 is a timing diagram for 2400 bits per second, showing the 2400 bits per second clock, the excitation which is at ⅓ of the data and is continuous at 800 bits per second. As seen therein, the framing for the spectrum has a synchronization bit, followed by channel one encoded at the full four bits. Channels 2 through 13 are differentially encoded using two bits, Channels 15 and 16 use one bit differential each. The frames rate is 20 milliseconds for the spectrum weighting, each frame consists of 32 bits which includes the frame synchronization bit.

FIG. 12 shows one implementation of a spectral flattener used to give a flat spectrum for all harmonics. Excitation generator 1200, as further described in FIG. 2 is coupled to a first channel filter bank 1201. The output of first channel filter bank 1201 is coupled to hard limiters 1202. The output of hard limiters 1202 is received at a second channel filter bank 1203 which is substantially identical to first channel filter bank 1201. This gives sinusoidal equal amplitude frequencies with the gain derived from the spectral encoded channels.

An alternate implementation comprises excitation generator item 1200 used to excite a first channel bank 1201, an automatic gain control on the output of each channel filter 1201, the output of channel filter 1201, then being applied to module 1204 which restores the original short term spectrum.

Figure 13:
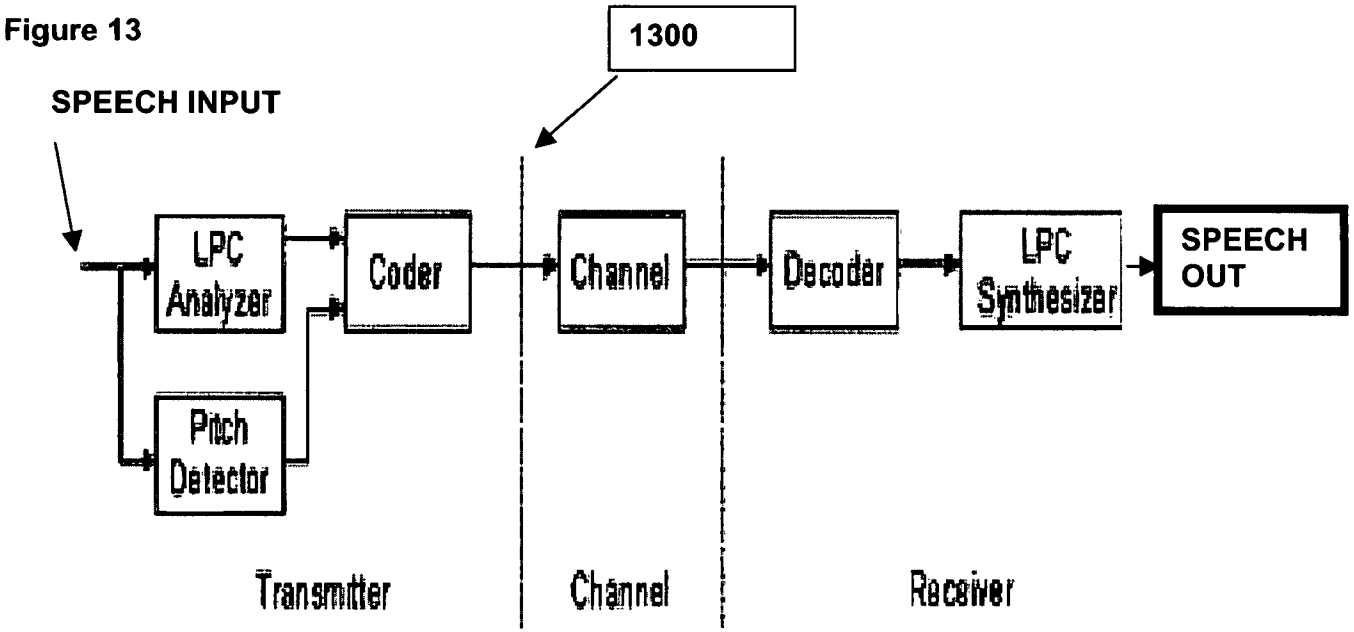
FIG. 13 shows a block diagram of a Linear Predictive Coded Vocoder using conventional voice/unvoiced decision and pitch tracking.
Figure 14:
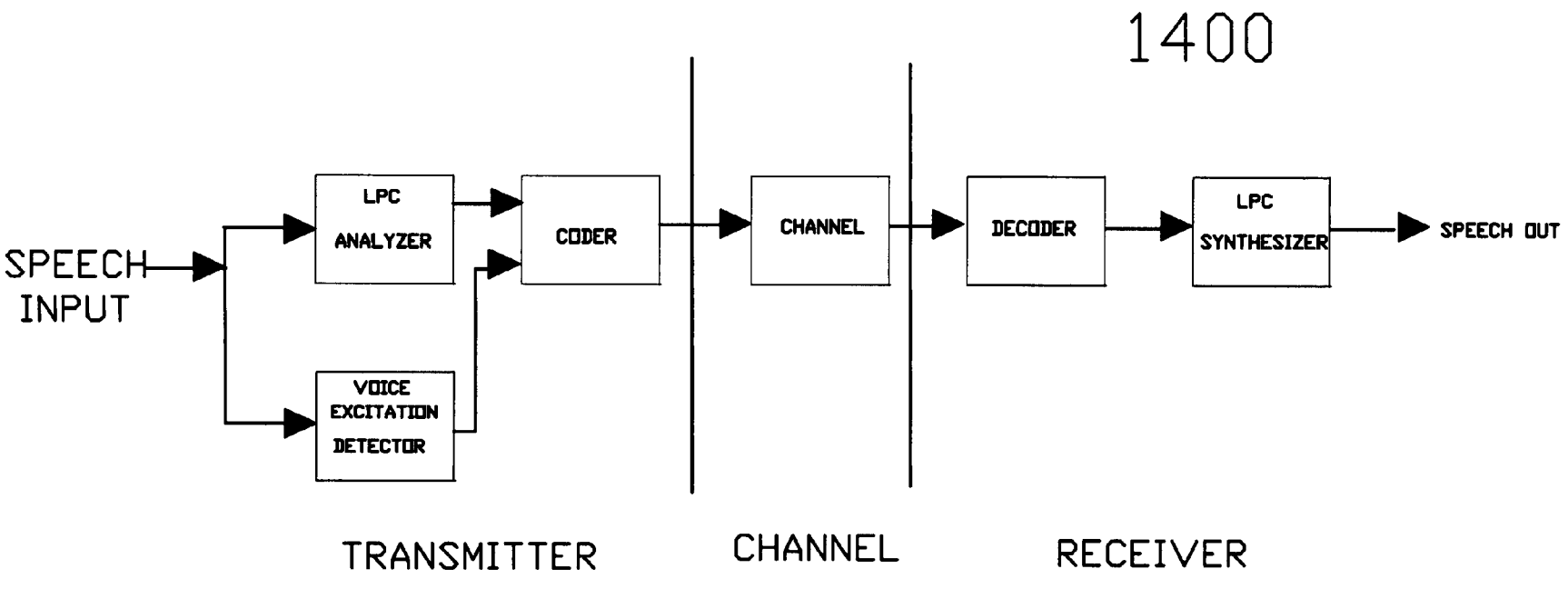
FIG. 14 shows a block diagram of a Linear Predictive Coded Vocoder using voice excitation.

FIG. 13 shows a conventional block diagram 1300 of a voice/unvoiced pitch excited Linear predictive vocoder and FIG. 14 shows a block diagram 1400 of a voice excited vocoder using the method of voice excitation of the present application.

The present application discloses a method and system for low bit rate voice encoding and decoding applicable for any reduced bandwidth requirements including wireless. In one embodiment of the present application, a system for encoding and decoding a voice comprises a vocoder transmitter and a vocoder receiver, wherein the transmitter further comprises: an automatic gain control module, a first formant filter, an excitation module operable to implement an excitation analysis, a spectrum analyzer module adapted to provide a short term frequency spectrum, an analog to digital converter coupled to the output of the spectrum analyzer module, a synchronous data channel, an asynchronous data channel, and a multiplexer operable to combine the outputs from the excitation module and the spectrum analyzer module into a single data stream that is clocked by at least one of: the synchronous data channel or the asynchronous data channel. In the system of claim 1, the automatic gain control is implemented in a digital circuit, the automatic gain control is implemented in an analog circuit, the automatic gain control is operable to adjust the long-term gain for each level of input, the automatic gain control uses only voiced (vocal tract) decisions to adjust the long term audio, the first formant filter is configured as a Bessel filter, wherein such filter is implemented using a digital circuit, wherein such filter is implemented using an analog circuit.

In the system, the spectrum analyzer module is adapted to provide a short term frequency spectrum in a bandwidth of between approximately 300 to 3000 Hertz, wherein the output of the spectrum analyzer module is converted by the analog to digital converter into a 4 bit amplitude for each frequency bands (linear predictive coding can be used for the spectrum information), wherein the synchronous data channel is a wireless channel, wherein the asynchronous data channel is a wireless channel, wherein the synchronous data channel is a digital channel, wherein the asynchronous channel is a digital channel, wherein the receiver further comprises: a module for multiply by two excitation extraction and non channel short term spectrum, wherein the receiver comprises a demultiplexer operable to separate the excitation from the short term spectrum weighting; an excitation synthesis module adapted to perform an excitation synthesis; a spectral flattener module operable to flatten the spectrum to give substantially equal amplitudes to all harmonics; a spectrum generator operable to process the spectrum weighting excited by the excitation synthesis module and synthesize speech, wherein the receiver is a non channel vocoder. The system is operable to encode and decode at least one of: a voice, at 2400 bits per second, or a voice, at 4800 bits per second.

In another embodiment of the present application, a system for encoding and decoding speech comprises an encoder including: a first module adapted to generate and output zero crossings in response to voice excitation in a first formant, a second module for dividing the output by two and sampling at 2400 Hertz for synchronous such that a resulting combination uses half of a bit rate for excitation and a remainder for short term spectrum analysis, and means for updating the spectrum each 20 milliseconds using 49 bits for bits for the spectrum and 49 bits for the excitation with one synchronizing bit per frame, and a decoder including: a first module for extracting the excitation, a second module adapted to multiply the excitation by two, a third module adapted to use a Hanning modified sawtooth and spectral flattening to excite a spectrum generator, and a fourth module for outputting a waveform that produces both even and odd harmonics for both periodic (voiced) and aperiodic (unvoiced) frequencies.

In a further embodiment of the present application, a system for encoding and decoding speech comprises an encoder including: a first module adapted to generate and output zero crossings in response to voice excitation in a first formant, a second module for dividing the output by two and sampling at (but not restricted to) 1600 Hertz (the formant frequency) for asynchronous such that a resulting combination uses the 1600 Hertz for excitation and the remainder for short term spectrum analysis, means for updating the spectrum each 21.25 milliseconds using 49 bits for the spectrum and 34 bits and one bit for synchronization giving 84 bits per frame, and a decoder including: a first module for extracting the excitation, a second module adapted to multiply the excitation by two, a third module adapted to use a Hanning modified sawtooth and spectral flattening to excite the spectrum generator, and a fourth module for outputting a waveform that produces both even and odd harmonics for both periodic (voiced) and aperiodic (unvoiced) frequencies.

Figure 15:
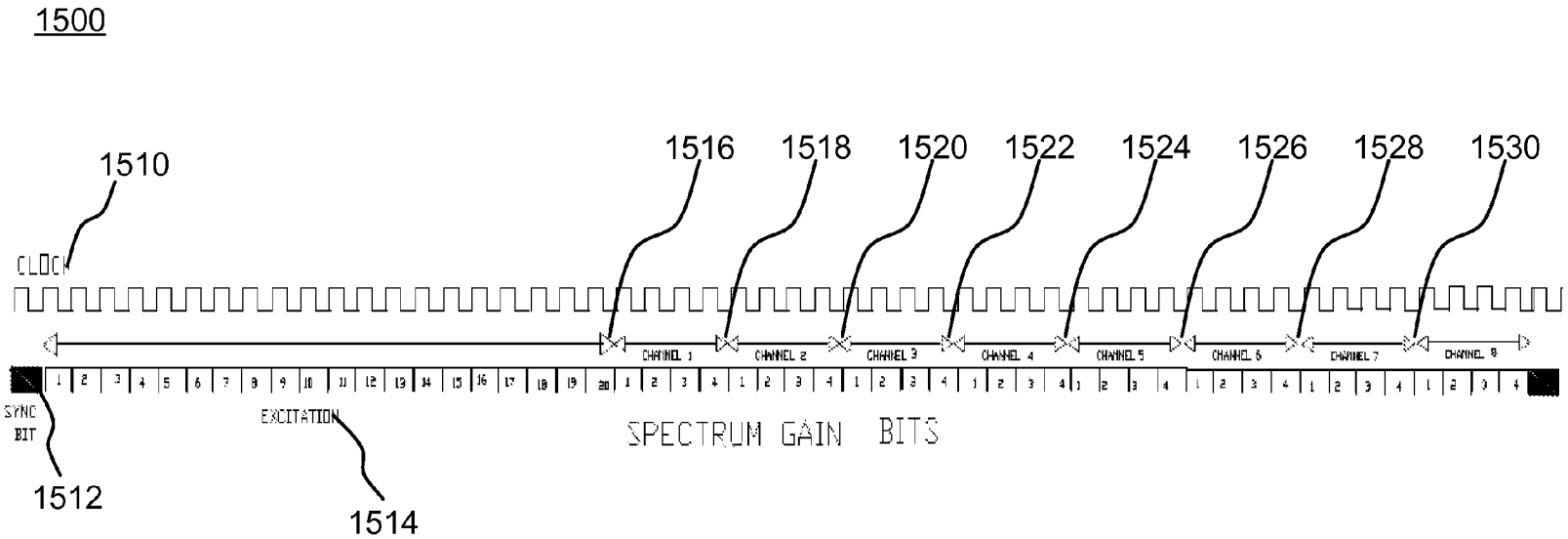
FIG. 15 illustrates another example timing diagram according to example embodiments of the present application.

FIG. 15 illustrates another example digital frame according to example embodiments. A digital voice signal may be sampled at 2400 bits per second (bps). The frame may include about 50 bits per frame and may be updated at 48 times per second to provide a 2400 bits per second data rate. Referring to FIG. 15, example embodiments of the present application use voice excitation and omit the voice/unvoiced pitch tracking. The example frame 1500 is illustrated to include a clock 1510 that is paired with the content of the frame which includes a synchronization bit 1512 and 20 bits of excitation data 1514, and also four bit channels 1516 through 1530 which represent 8 separate channels at four bits each to provide a spectrum gain coding of 32 bits of data and 1 synchronization bit.

The power spectrum band of frequencies is encoded using four bits for the magnitude as channels 1-8 each use four bits 1516-1530 for the magnitude. The spectrum gain coding is 32 bits and 1 synchronization bit 112 or 33 bits. The frame rate×frames/second which may be 33 bits×45 frames per second=1485 bits per second. The excitation=20 bits per frame and the excitation is thus 915 bits per second and 1485 bits per second+915 bits per second=2400 bits per second.

When processing the voice sample, the first formant identified up to 950 Hertz is processed not by using pulse code modulation encoding, but instead by using the zero crossings only of the first formant, dividing by two and sampling at 950 Hertz. The resulting combination uses half of the bit rate for excitation and the remainder of the bit rate may be used for short-term spectrum analysis.

The spectrum may be updated 48 times per second using 50 bits per frame. This technique provides high intelligibility with good speaker recognition. The decoder extracts the excitation, multiplies it by two and uses a Hanning modified sawtooth window and spectral flattening to excite the spectrum generator. This waveform produces both even and odd harmonics for both periodic (voiced) and aperiodic (unvoiced) frequencies and gives naturalness to all languages and speakers who may be providing a voice sample.

Figure 16:
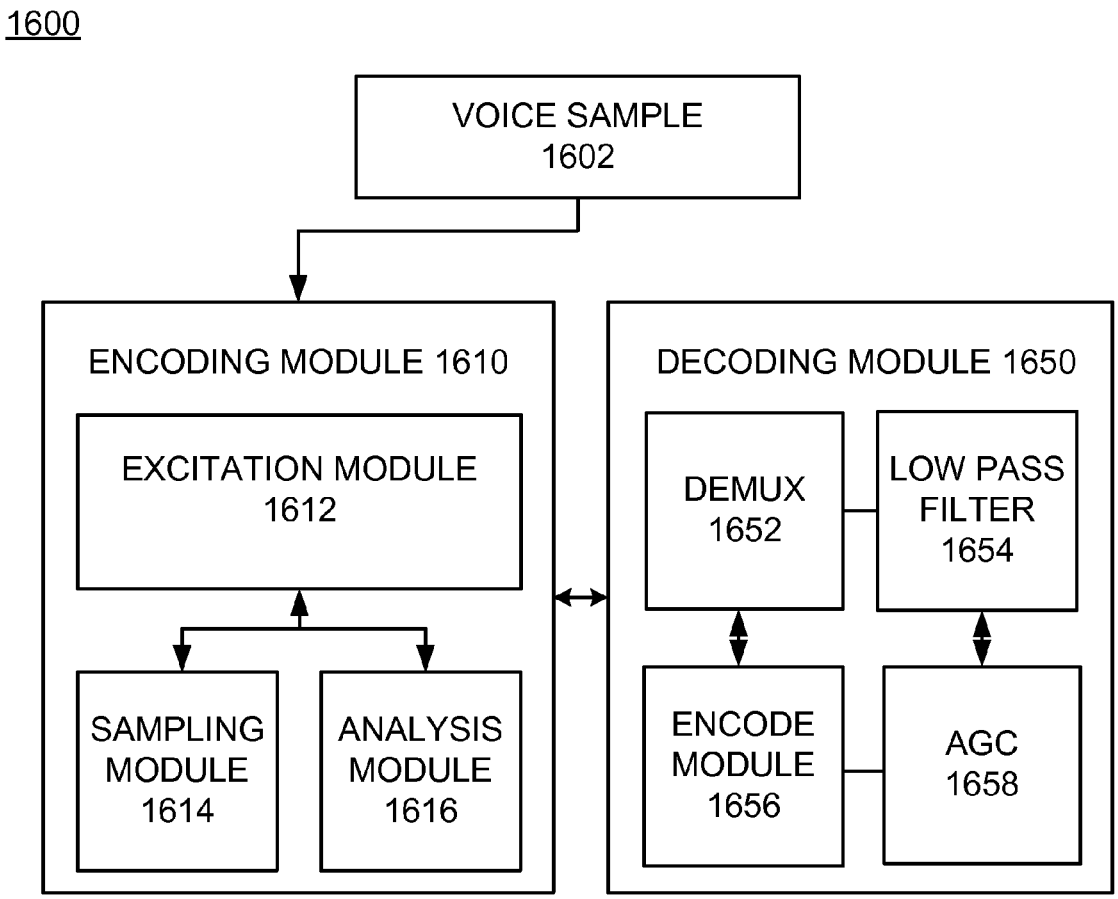
FIG. 16 illustrates an example logic diagram of a voice processing and encoding/decoding device according to example embodiments.

FIG. 16 illustrates a logic diagram 1600 of the encoding and decoding performed to a voice sample according to example embodiments. Referring to FIG. 16, the voice sample 1602 may be received at an encoding module 1610 which may be a software and/or hardware device configured to process the sample. The sample may be digitized and sampled via the sampling module 1614 at 2400 bits per second and analyzed via the analysis module 1616 to create 50 bits per frame at 48 times per second. The excitation of the signal may be processed via the excitation module 1612 to create 20 bits of data per frame. The signal may be received and decoded via a decoding module 1650 at a remote site and de-multiplexed via demux 1652, and the power spectrum gain for each band of frequencies is generally 30 dB. The channel bandwidths for the short-term spectrum are rectified and filtered via a low pass filter 1654, then encoded via encoding module 1656 using 5 bits for the power level. Because of the close correlation of the adjacent spectrum levels, automatic gain control (AGC) is required for optimum performance. The AGC module 1658 is digitally controlled, and is permitted to adjust the gain during voiced speech as opposed to other audio signals in the speech sample. The update rate uses a 20 Hertz frequency. A voicing decision module compares the lower speech frequency coefficients to the higher speech frequencies and if the lower frequencies energy is higher, then the AGC is permitted to adjust the gain. The AGC provides an additional 24 dB giving a total dynamic range equal to what a standard pulse code modulation (PCM) codec would process.

At the decoder 1650, the excitation is demultiplexed via demux 1652, the excitation is multiplied by two and the pulses are converted to a Hanning modified sawtooth that is spectrally flattened to give equal amplitudes to all of the harmonics and used as excitation for a spectrum generator. The gain coefficients are decoded and used to synthesize the voice. The resultant synthesis sounds natural and the intelligibility is as good as a toll quality telephone line.

Although the description of the application may us analog circuits to more easily describe voice excitation, the implementation can be easily realized using digital signal processing techniques and microprocessors or linear predictive spectral encoding and adopt readily available conventional codecs. The 2400 bits per second vocoder of the present application restricts the first formant to 950 Hertz. It then uses the same technique of zero crossings and dividing by two of the first formant. The excitation then is 950 bits per second. This leaves 1450 bits to encode the spectral information.

The spectrum frame rate may be 20.8 milliseconds (ms). The frequency amplitude spectrum is encoded using either a predictive short-term frequency analysis, bandpass filter channels or a Fast Fourier Transform (FFT). If bandpass channels are implemented then the correlation between spectrum amplitude frequency analysis bands is good and fewer bits are needed to send spectrum information, similar to predictive encoding. The spectral information uses 32 bits per frame with one frame as a synchronization (sync) bit.

At the decoder, the excitation is demultiplexed, the excitation is passed through a 400 Hertz low pass filter multiplied by two and the zero crossings are converted to the Hanning modified sawtooth that is spectrally flattened and used as excitation for the spectrum generator. According to another example embodiment, at the decoder, the excitation is demultiplexed, the excitation is passed through a 950

Hertz low pass filter multiplied by two and the zero crossings are converted to the Hanning modified sawtooth that is spectrally flattened and used as excitation for the spectrum generator.

Figure 17:
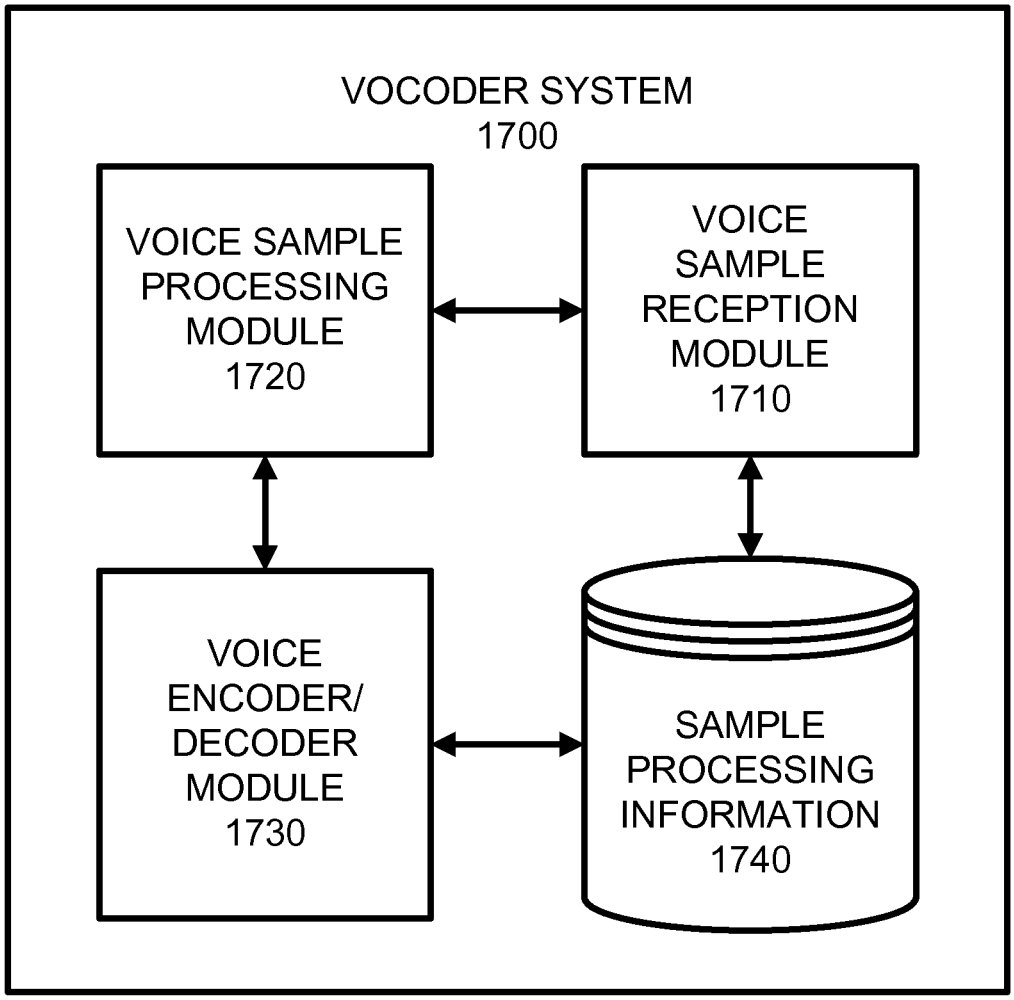
FIG. 17 illustrates an example system communication diagram according to example embodiments of the present application.

FIG. 17 illustrates an example system 1700 configured to perform any of the above-noted example methods and procedures. Referring to FIG. 17, the system 1700 may include a receiver and a transmitter for processing and receiving/transmitting voice signals. The voice sample reception module 1710 may receive a voice sample and the voice sample processing module 1720 may provide an encoder that processes the signal, and which has a zero crossings calculation module that generates and outputs zero crossings of the voice sample in response to voice excitation in a first formant. The processing module 1720 may also have an analog to digital converter, and other preprocessing modules. The voice encoder and decoder module 1720 may provide a sampling module configured to divide the output signal by two and sample at a predefined frequency such that a resulting combination uses half of a bit rate for an excitation signal and a remainder for short term spectrum analysis.

The sampling module is further configured to update a spectrum of the output signal 48 times per second using 50 bits per frame. According to specific examples, the first formant is limited to a frequency of 950 Hertz and the predefined frequency is 950 Hertz. The sampling module may further process the voice sample to create a plurality of frames that are less than half excitation bits and more than half coding bits. The excitation bits are equal to 20 bits and the coding bits are equal to 32 bits. The transmitter is configured to transmit the plurality of frames to a decoding device.

The system 1700 may also include a decoder that provides an extraction module configured to extract the excitation signal and a signal processing module configured to multiply the excitation by two, use a Hanning modified sawtooth to convert the zero crossings and generate a Hanning modified sawtooth signal, and perform spectral flattening on the Hanning modified sawtooth signal to excite a spectrum generator. An output module may be configured to output a waveform that produces both even and odd harmonics for both periodic and aperiodic frequencies. The system 1700 may also provide a demultiplexer to demultiplex the excitation signal and filter the excitation signal via a low pass filter. The low pass filter may be a 400 Hertz filter or a 950 Hertz filter.

The operations of a method or algorithm described in connection with the embodiments disclosed herein may be embodied directly in hardware, in a computer program executed by a processor, or in a combination of the two. A computer program may be embodied on a computer readable medium, such as a storage medium. For example, a computer program may reside in random access memory ("RAM"), flash memory, read-only memory ("ROM"), erasable programmable read-only memory ("EPROM"), electrically erasable programmable read-only memory ("EEPROM"), registers, hard disk, a removable disk, a compact disk read-only memory ("CD-ROM"), or any other form of storage medium known in the art.

An exemplary storage medium may be coupled to the processor such that the processor may read information from, and write information to, the storage medium. In the alternative, the storage medium may be integral to the processor. The processor and the storage medium may reside in an application specific integrated circuit ("ASIC"). In the alternative, the processor and the storage medium may reside as discrete components. For example FIG. 18 illustrates an example network element 1800, which may represent any of the above-described network components of the other figures.

Figure 18:
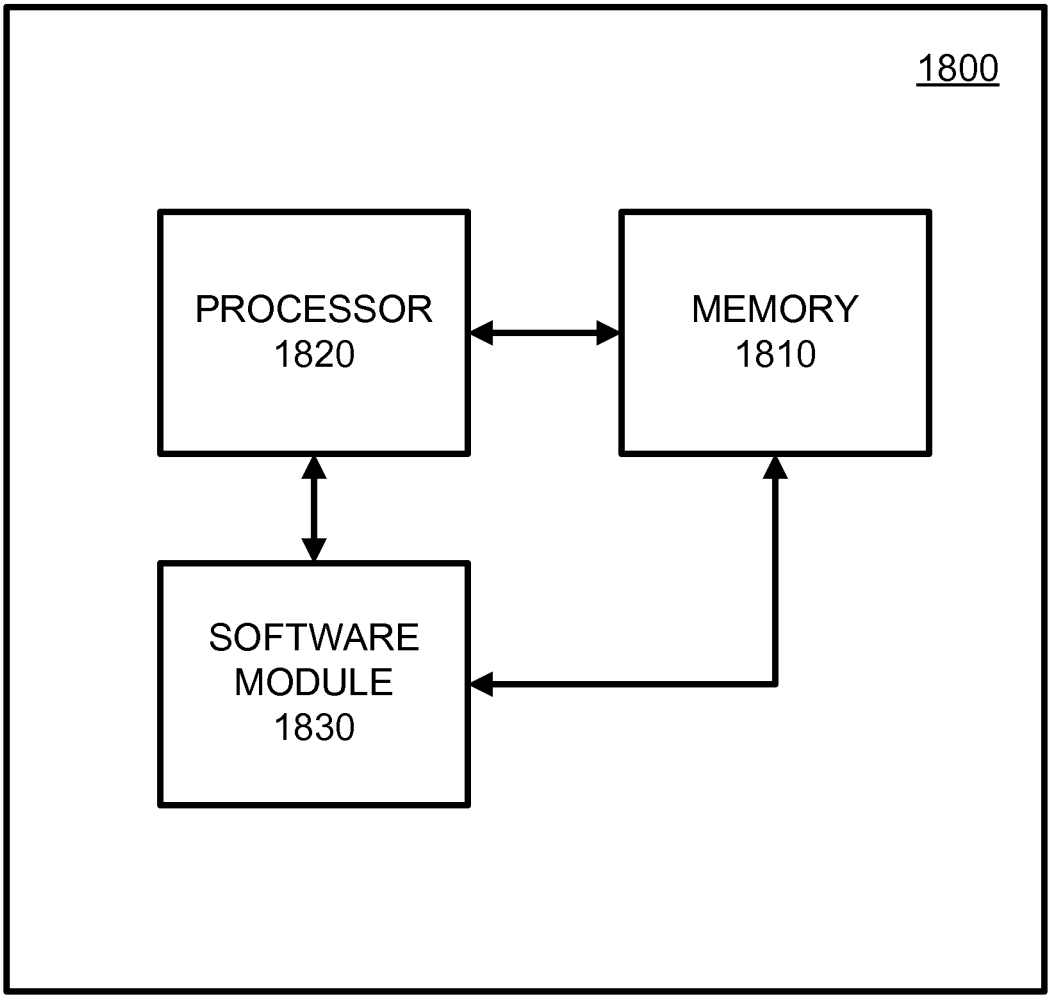
FIG. 18 illustrates an example network entity device configured to store instructions, software, and corresponding hardware for executing the same, according to example embodiments of the present application.

As illustrated in FIG. 18, a memory 1810 and a processor 1820 may be discrete components of the network entity 1800 that are used to execute an application or set of operations. The application may be coded in software in a computer language understood by the processor 1820, and stored in a computer readable medium, such as, the memory 1810. The computer readable medium may be a non-transitory computer readable medium that includes tangible hardware components in addition to software stored in memory. Furthermore, a software module 1830 may be another discrete entity that is part of the network entity 1800, and which contains software instructions that may be executed by the processor 1820. In addition to the above noted components of the network entity 1800, the network entity 1800 may also have a transmitter and receiver pair configured to receive and transmit communication signals (not shown).

Although an exemplary embodiment of the system, method, and computer readable medium of the present application has been illustrated in the accompanied drawings and described in the foregoing detailed description, it will be understood that the application is not limited to the embodiments disclosed, but is capable of numerous rearrangements, modifications, and substitutions without departing from the spirit or scope of the application as set forth and defined by the following claims. For example, the capabilities of the system of FIG. 17 can be performed by one or more of the modules or components described herein or in a distributed architecture and may include a transmitter, receiver or pair of both. For example, all or part of the functionality performed by the individual modules, may be performed by one or more of these modules. Further, the functionality described herein may be performed at various times and in relation to various events, internal or external to the modules or components. Also, the information sent between various modules can be sent between the modules via at least one of: a data network, the Internet, a voice network, an Internet Protocol network, a wireless device, a wired device and/or via plurality of protocols. Also, the messages sent or received by any of the modules may be sent or received directly and/or via one or more of the other modules.

One skilled in the art will appreciate that a "system" could be embodied as a personal computer, a server, a console, a personal digital assistant (PDA), a cell phone, a tablet computing device, a smartphone or any other suitable computing device, or combination of devices. Presenting the above-described functions as being performed by a "system" is not intended to limit the scope of the present application in any way, but is intended to provide one example of many embodiments of the present application. Indeed, methods, systems and apparatuses disclosed herein may be implemented in localized and distributed forms consistent with computing technology.

It should be noted that some of the system features described in this specification have been presented as modules, in order to more particularly emphasize their implementation independence. For example, a module may be implemented as a hardware circuit comprising custom very large scale integration (VLSI) circuits or gate arrays, off-the-shelf semiconductors such as logic chips, transistors, or other discrete components. A module may also be implemented in programmable hardware devices such as field programmable gate arrays, programmable array logic, programmable logic devices, graphics processing units, or the like.

A module may also be at least partially implemented in software for execution by various types of processors. An identified unit of executable code may, for instance, comprise one or more physical or logical blocks of computer instructions that may, for instance, be organized as an object, procedure, or function. Nevertheless, the executables of an identified module need not be physically located together, but may comprise disparate instructions stored in different locations which, when joined logically together, comprise the module and achieve the stated purpose for the module. Further, modules may be stored on a computer-readable medium, which may be, for instance, a hard disk drive, flash device, random access memory (RAM), tape, or any other such medium used to store data.

Indeed, a module of executable code could be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

It will be readily understood that the components of the application, as generally described and illustrated in the figures herein, may be arranged and designed in a wide variety of different configurations. Thus, the detailed description of the embodiments is not intended to limit the scope of the application as claimed, but is merely representative of selected embodiments of the application.

The innovative teachings of the present application are described with particular reference to analog circuits and bandwidths to more easily describe voice excitation. However, it should be understood and appreciated by those skilled in the art that the embodiments described herein provides only a few examples of the innovative teachings herein. Various alterations, modifications and substitutions can be made to the method of the disclosed application and the system that implements the present application without departing in any way from the spirit and scope of the application. For example, the implementation can be easily realized using digital signal processing techniques and microprocessors, or Linear Predictive techniques and readily available conventional codecs.

One having ordinary skill in the art will readily understand that the application as discussed above may be practiced with steps in a different order, and/or with hardware elements in configurations that are different than those which are disclosed. Therefore, although the application has been described based upon these preferred embodiments, it would be apparent to those of skill in the art that certain modifications, variations, and alternative constructions would be apparent, while remaining within the spirit and scope of the application. In order to determine the metes and bounds of the application, therefore, reference should be made to the appended claims.

While preferred embodiments of the present application have been described, it is to be understood that the embodiments described are illustrative only and the scope of the application is to be defined solely by the appended claims when considered with a full range of equivalents and modifications (e.g., protocols, hardware devices, software platforms etc.) thereto.

What is claimed is:

1. An apparatus, comprising:

an encoder configured to generate and output zero crossings of a voice sample for a first formant in response to voice excitation in the first formant, and divide the output zero crossings of the voice sample for the first formant signal by two and sample at a frequency of the first formant thereby generating a plurality of frames that use no more than half of a bit rate for an excitation signal and a remainder of the bit rate for short term spectrum analysis;

a transmitter configured to transmit the plurality of frames;

a decoder configured to receive the plurality of frames and extract an excitation signal from the plurality of frames;

a signal processing module configured to convert the excitation signal into a Hanning modified sawtooth signal, and perform spectral flattening on the Hanning modified sawtooth signal to excite a spectrum generator; and an output configured to output a waveform based on the Hanning modified sawtooth signal which produces both even and odd harmonics for both periodic and aperiodic frequencies.

2. The apparatus of claim 1, wherein the encoder is further configured to update a spectrum of the output signal 48 times per second using 50 bits per frame.

3. The apparatus of claim 1, wherein the first formant is limited to a frequency of 950 Hertz.

4. The apparatus of claim 1, wherein the frequency of the first formant is 950 Hertz.

5. The apparatus of claim 1, wherein the plurality of frames comprise a bit rate of less than half excitation bits and more than half coding bits.

6. The apparatus of claim 5, wherein, for each frame, the excitation bits are equal to 20 bits and the coding bits are equal to 32 bits.

7. The apparatus of claim 1, further comprising:

a demultiplexer configured to demultiplex the excitation signal and filter the excitation signal via a low pass filter.

8. The apparatus of claim 7, wherein the low pass filter is a 400 Hertz filter.

9. The apparatus of claim 7, wherein the low pass filter is a 950 Hertz filter.

10. A method comprising:

generating zero crossings of a voice sample for a first formant in response to voice excitation in the first formant and creating a corresponding zero crossings output signal;

dividing the zero crossings output signal by two;

sampling the divided zero crossings output signal at a frequency of the first formant thereby generating a plurality of frames that use no more than half of a bit rate for an excitation signal and a remainder of the bit rate for short term spectrum analysis;

transmitting the plurality of frames;

receiving the plurality of frames and extracting an excitation signal therefrom;

converting the excitation signal into a Hanning modified sawtooth signal, and perform spectral flattening on the Hanning modified sawtooth signal to excite a spectrum generator; and outputting a waveform based on the Hanning modified sawtooth signal which produces both even and odd harmonics for both periodic and aperiodic frequencies.

11. The method of claim 10, further comprising:

updating a spectrum of the output signal 48 times per second using 50 bits per frame.

12. The method of claim 10, wherein the first formant is limited to a frequency of 950 Hertz.

13. The method of claim 10, wherein the frequency of the first formant is 950 Hertz.

14. The method of claim 10, wherein the plurality of frames comprise a bit rate of less than half excitation bits and more than half coding bits.

15. The method of claim 14, wherein, for each frame, the excitation bits are equal to 20 bits and the coding bits are equal to 32 bits.

16. A non-transitory computer readable storage medium configured to store instructions that when executed cause a processor to perform:

generating zero crossings of a voice sample for a first formant in response to voice excitation in the first formant and creating a corresponding zero crossings output signal;

dividing the zero crossings output signal by two;

sampling the divided zero crossings output signal at a frequency of the first formant thereby generating a plurality of frames that use no more than half of a bit rate for an excitation signal and a remainder of the bit rate for short term spectrum analysis;

transmitting the plurality of frames;

receiving the plurality of frames and extracting an excitation signal therefrom;

converting the excitation signal into a Hanning modified sawtooth signal, and perform spectral flattening on the Hanning modified sawtooth signal to excite a spectrum generator; and outputting a waveform based on the Hanning modified sawtooth signal which produces both even and odd harmonics for both periodic and aperiodic frequencies.

17. The apparatus of claim 1, wherein the encoder further comprises a multiplexer that is configured to receive the divided and sampled zero crossings output signal and generate the plurality of frames.

18. The apparatus of claim 1, wherein the signal processing module is configured to multiply the excitation signal by two using a Hanning modified sawtooth to convert zero crossings from the voice excitation signal into the Hanning modified sawtooth signal.

* * * * *